US009473855B2

(12) United States Patent
van Halteren et al.

(10) Patent No.: US 9,473,855 B2
(45) Date of Patent: *Oct. 18, 2016

(54) MOVING ARMATURE RECEIVER ASSEMBLIES WITH VIBRATION SUPPRESSION

(71) Applicant: Sonion Nederland B.V., Hoofddorp (NL)

(72) Inventors: Aart Zeger van Halteren, Hobrede (NL); Andreas Tiefenau, Zaandam (NL); Adrianus Maria Lafort, Delft (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/314,240

(22) Filed: Jun. 25, 2014

(65) Prior Publication Data

US 2014/0305735 A1 Oct. 16, 2014

Related U.S. Application Data

(63) Continuation-in-part of application No. 13/422,746, filed on Mar. 16, 2012, now Pat. No. 8,792,672.

(60) Provisional application No. 61/454,759, filed on Mar. 21, 2011.

(51) Int. Cl.

| | |
|---|---|
| ***H04R 11/02*** | (2006.01) |
| ***G10K 11/16*** | (2006.01) |
| ***H04R 1/40*** | (2006.01) |
| ***H04R 1/28*** | (2006.01) |

(Continued)

(52) U.S. Cl.

CPC ..... *H04R 11/02* (2013.01); *G10K 11/16* (2013.01); *H04R 1/2873* (2013.01); *H04R 1/403* (2013.01); *H04R 1/227* (2013.01); *H04R 25/00* (2013.01)

(58) Field of Classification Search

CPC .... H04R 11/02; H04R 11/04; H04R 1/2873; H04R 1/288; H04R 1/2888; H04R 1/2896; H04R 1/403

USPC ..... 381/417, 418, 317, 318, 322, 324, 312, 381/351, 342, 186, 398, 395, 354; 181/161, 181/163, 199

See application file for complete search history.

(56) References Cited

U.S. PATENT DOCUMENTS 4,109,116 A * 8/1978 Victoreen ..... 381/318
6,078,677 A * 6/2000 Dolleman et al. ..... 381/418

(Continued)

FOREIGN PATENT DOCUMENTS

EP 1353531 A2 10/2013

OTHER PUBLICATIONS

Extended European Search Report, Dated Aug. 7, 2013 (7 pages).

*Primary Examiner* — Curtis Kuntz
*Assistant Examiner* — Joshua Kaufman
(74) *Attorney, Agent, or Firm* — Nixon Peabody LLP

(57) ABSTRACT

Moving armature receiver assemblies wherein a first U-shaped armature and a second U-shaped armature are configured for suppression of vibration of a housing structure along a longitudinal housing plane. The first and second U-shaped armatures may be shifted away from each other along a longitudinal housing plane to render the first and second U-shaped armatures partially overlapping in the orthogonal plane with a predetermined overlap distance.

16 Claims, 9 Drawing Sheets

(51) Int. Cl.
*H04R 1/22* (2006.01)
*H04R 25/00* (2006.01)

(56) References Cited

U.S. PATENT DOCUMENTS 6,563,933 B1 * 5/2003 Niederdraenk ..... 381/417
7,190,803 B2 * 3/2007 van Halteren ..... 381/398
8,160,283 B2 * 4/2012 Saltykov et al. ..... 381/318
8,792,672 B2 * 7/2014 van Halteren et al. ..... 381/418
2003/0190053 A1 * 10/2003 van Halteren ..... 381/418
2007/0223735 A1 * 9/2007 LoPresti et al. ..... 381/99
2008/0031481 A1 * 2/2008 Warren et al. ..... 381/322
2008/0063223 A1 * 3/2008 van Halteren et al. ..... 381/182
2008/0247578 A1 * 10/2008 Saltykov et al. ..... 381/318
2009/0220113 A1 * 9/2009 Tiscareno ..... 381/309
2010/0128905 A1 * 5/2010 Warren et al. ..... 381/312
2010/0284561 A1 * 11/2010 Miller et al. ..... 381/418
2014/0185851 A1 * 7/2014 van Halteren ..... 381/328

* cited by examiner

MOVING ARMATURE RECEIVER ASSEMBLIES WITH VIBRATION SUPPRESSION

CROSS-REFERENCE TO RELATED APPLICATION

This application is a continuation-in-part of prior application Ser. No. 13/422,746, filed Mar. 16, 2012, now allowed, entitled "Moving Armature Receiver Assemblies with Vibration Suppression", which claims the benefit of U.S. Provisional Ser. No. 61/454,759, filed Mar. 21, 2011, both of which are incorporated herein by reference in their entireties.

FIELD OF THE INVENTION

The present invention relates to moving armature receiver assemblies wherein a first U-shaped armature and a second U-shaped armature are configured for suppression of vibration of a housing structure along a longitudinal housing plane. The first and second U-shaped armatures may be shifted away from each other along a longitudinal housing plane to render the first and second U-shaped armatures partially overlapping in the orthogonal plane with a predetermined overlap distance.

BACKGROUND OF THE INVENTION

Moving armature receivers are widely used to convert electrical audio signals into sound in portable communication applications such as hearing instruments, headsets, in-ear-monitors, earphones etc. Moving armature receivers convert the electrical audio signal to sound pressure or acoustic energy through a motor assembly having a movable armature. The armature typically has a displaceable leg or segment that is free to move while another portion is fixed to a housing or magnet support of the moving armature receiver. The motor assembly includes a drive coil and one or more permanent magnets, both capable of magnetically interacting with the armature. The movable armature is typically connected to a diaphragm through a drive rod or pin placed at a deflectable end of the armature. The drive coil is electrically connected to a pair of externally accessible drive terminals positioned on a housing of the miniature moving armature receiver. When the electrical audio or drive signal is applied to the drive coil the armature is magnetized in accordance with the audio signal. Interaction of the magnetized armature and a magnetic field created by the permanent magnets causes the displaceable leg of the armature to vibrate. This vibration is converted into corresponding vibration of the diaphragm due to the coupling between the deflectable leg of the armature and the diaphragm so as to produce the sound pressure. The generated sound pressure is typically transmitted to the surrounding environment through an appropriately shaped and sized sound port or spout attached to the housing or casing of the moving armature receiver.

However, the vibration of the deflectable leg of the armature and corresponding vibration of the diaphragm causes a housing structure of the moving armature receiver to vibrate in a complex manner with vibration components generally extending in all spatial dimensions e.g. along a longitudinal housing plane (e.g. chosen as x-axis direction) and housing planes perpendicular thereto (e.g. chosen as y-axis and z-axis directions).

These vibration components are undesirable in numerous applications such as hearing instruments or other personal communication devices where these vibrations may cause feedback oscillation due to the coupling of mechanical vibration from the housing of the moving armature receiver to a vibration sensitive microphone of the personal communication device. Moving armature receivers or loudspeakers have therefore conventionally been mounted in resilient suspensions in many types of personal communication device such as Behind-The-Ear and In-The-Ear hearing aids to suppress or attenuate mechanical vibrations to prevent these from being transmitted to a microphone of the hearing aid. Conventional or prior art resilient suspensions include elastomeric rubber boots and elastomeric strips or ribbons mounted to partly or fully enclose the receiver housing. However, these resilient suspensions exhibit relatively small compliance or large stiffness along a longitudinal housing plane of the receiver while exhibiting a much larger compliance in the housing planes transversal to the longitudinal housing plane.

In prior art moving armature receivers efforts have been made to reduce the level of vibration for example by designing dual-diaphragm receivers such that a first and a second armature have been arranged in a mirror-symmetrical fashion about a central longitudinal housing plane extending through the dual-diaphragm receiver. U.S. Pat. No. 4,109,116 discloses such a miniature dual-diaphragm moving armature receiver for hearing aid applications. The dual-diaphragm receiver is formed as a back-to-back mounted assembly of two conventional single diaphragm moving armature receivers to achieve suppression of mechanical vibrations of the receiver. The disclosed dual-diaphragm receiver comprises a pair of U-shaped armatures mounted mirror-symmetrically around a central longitudinal plane extending in-between a pair of abutted separate housing structures. During operation, deflectable legs of the two U-shaped armatures, and respective diaphragms coupled thereto, move in opposite directions in a plane perpendicular to the central longitudinal housing plane to suppress vibrations along the perpendicular plane.

Unfortunately, this type of mirror-symmetrical dual-receiver design is not very efficient in cancelling or attenuating mechanical vibrations along the central longitudinal plane of the receiver housing. The linkage segments of the U-shaped armatures will move simultaneously in the same longitudinal direction so as to reinforce vibration instead of cancelling vibration in the longitudinal plane.

Since the U-shaped armature geometry generally possesses numerous advantageous properties such as large armature compliance for given armature dimensions and a small width, a moving armature receiver assembly based on two or more U-shaped armatures with a reduced level of housing vibration, in particular along the longitudinal housing plane of the receiver, would be an improvement in the art.

SUMMARY OF INVENTION

A first aspect of the invention relates to a moving armature receiver assembly comprising a housing structure having a longitudinal housing plane; the housing structure enclosing:

a first U-shaped armature comprising a fixed leg and a deflectable leg both extending parallelly to a first longitudinal armature plane and mechanically and magnetically interconnected through a first curved linkage portion, a second U-shaped armature comprising a fixed leg and a deflectable leg both extending parallelly to a second longitudinal armature plane and mechanically and magnetically interconnected through a second curved linkage portion. In accordance with the invention, the first and second first U-shaped armatures are configured for suppression of vibration of the housing structure in direction of the longitudinal housing plane. The suppression of mechanical vibration is achieved in several different ways in accordance with the various embodiments of the invention as described below in further detail. The simultaneous displacement in the same direction of the first and second curved linkage portions, or necks, of the U-shaped armatures in prior art dual-receivers makes a large contribution to mechanical vibration along the longitudinal housing plane as explained above. Therefore, one group of advantageous embodiments of the present invention suppresses mechanical vibration along the longitudinal housing plane by configuring the first and second curved linkage portions for oppositely directed displacement or movement along the longitudinal housing plane.

Another embodiment of the present moving armature receiver assembly suppresses mechanical vibration in direction of the longitudinal housing plane by rotating the first and second U-shaped armatures in opposite directions about the longitudinal housing plane. If the U-shaped armatures are rotated in such a way that the resulting force components acting on the vibrating deflectable legs of both U-shaped armatures lie on the same axis, but project in opposite direction, considerable suppression of the resulting force components is achieved.

The skilled person will understand that the term "fixed leg" as applied in the present specification does not rule out that a portion of the fixed leg is able to vibrate or be deflected to some extent albeit with a smaller vibration amplitude than the corresponding deflectable leg. Only a limited portion of the fixed leg may be rigidly fastened to a magnet housing of the moving armature receiver assembly or fastened to another stationary structure thereof. The magnet housing may be magnetically and mechanically coupled to a pair of permanents magnets between which a magnet gap is formed. A deflectable leg of the first or second U-shaped armature preferably extends through the magnet gap.

The moving armature receiver assembly preferably comprises one or more drive coils forming one or more coil tunnels or apertures surrounding at least a section of the first or the second deflectable leg of the respective U-shaped armature. By application of an audio or AC signal to the drive coil or coils, a magnetic flux through the first and second deflectable legs alternates in a corresponding manner such that the first and second deflectable legs are displaced or vibrates in a direction perpendicular to the first and second longitudinal armature planes.

The first and second curved linkage portions, or necks, of the first and second U-shaped armatures preferably comprise respective curved segments such as semi-circular segments or arc-shaped segments. The skilled person will, however, understand that "U-Shaped" as applied in the present specification covers all types of curved or similarly shaped curved linkage portions with different radii of curvature. Likewise, the curved linkage portion may comprise an intermediate straight section joined to a pair of curved linkage portions.

In one embodiment of the invention, the deflectable leg of the first U-shaped armature and the deflectable leg of the second U-shaped armature project into a common magnet gap. The magnet gap may be formed between outer surfaces of a pair of oppositely positioned permanent magnets. The use of a common or shared magnet gap is advantageous for several reasons such as to minimize overall dimensions of the moving armature receiver assembly. Smaller dimensions are a significant advantage in hearing instrument applications and other size constrained applications. Furthermore, the common or shared magnet gap is also beneficial in reducing the number of separate components of a motor assembly or system of the moving armature receiver assembly. In addition, the number of manufacturing steps required to produce the moving armature receiver assembly may be reduced. Both of these latter factors are effective in reducing the total manufacturing costs of the moving armature receiver.

In one such embodiment, the first and second U-shaped armatures are positioned mirror symmetrically about the longitudinal housing plane extending in-between the first and second U-shaped armatures so as to orient the first and second U-shaped armatures in same direction along the longitudinal housing plane. This mirror symmetrical orientation of the U-shaped armatures means that the deflectable leg of the first U-shaped armature and the deflectable leg of the second U-shaped armature extend parallelly to each other in close proximity along the longitudinal housing plane for example separated by an air gap with a height between 2 and 20 μm, more preferably between 5 and 10 μm. Furthermore, the first and second curved linkage portions are similarly oriented along the longitudinal housing plane, i.e. the curved linkage portions "points" in the same direction. The mirror symmetrical orientation of the U-shaped armatures in connection with the shared magnet gap means that both deflectable legs are displaced simultaneously in the same direction perpendicular to the longitudinal housing plane, i.e. in a z-axis direction. Consequently, the first and second curved linkage portions are displaced in opposite directions along the longitudinal housing plane so as to suppress or attenuate mechanical vibration in the latter plane. One or both of the displaceable legs may be coupled to a diaphragm through a suitable drive pin or pins so that vibratory motion of the displaceable leg(s) are conveyed to the diaphragm for sound pressure generation. This embodiment can provide a moving armature receiver assembly with small height and small length due to a close proximity of the U-shaped armatures and their alignment below each other. While the vibration suppression in the z-axis direction may be less than the suppression obtainable in other embodiments of the present invention due to the simultaneous displacement of the deflectable legs in the same z-axis direction, an overall length of the first and second U-shaped armatures can be made very small. In addition, suppression of vibrational torque or rotational force components can also be effective because drive pins or rods, coupling the deflectable legs to a shared compliant diaphragm, can be placed in close proximity on the respective deflectable legs of the first and second U-shaped armatures.

In yet another embodiment of the invention where deflectable legs are projecting into the common magnet gap, the deflectable legs of the first and second U-shaped armatures are both positioned in the longitudinal housing plane and without overlap in the z-axis plane. Since the deflectable legs are aligned along the longitudinal housing plane each of the deflectable legs projects into a partial portion of the common magnet gap such that end surfaces of the deflectable legs are separated by a small gap. The deflectable leg of the first U-shaped armature preferably project the same distance into the common magnet gap as the deflectable leg of the second U-shaped armature to match the magnetic forces acting on the deflectable legs to displace these. In this embodiment, the deflectable leg of the first U-shaped armature may for example occupy about 50% of a width of the common magnet gap and the deflectable leg of the second U-shaped armature also occupy about 50% of the width of the common magnet gap.

In yet another embodiment of the present moving armature receiver assembly where the deflectable legs are arranged in the common magnet gap, dimensions of first and second U-shaped armatures are substantially identical. Furthermore, the deflectable leg of the first U-shaped armature is preferably coupled to a first compliant diaphragm and the deflectable leg of the second U-shaped armature coupled to a second compliant diaphragm. Effective vibration suppression of the housing structure along the longitudinal housing plane can be achieved by situating identically sized portions of the deflectable legs in the common magnet gap and use essentially identical mechanical and acoustical characteristics of the first and second compliant diaphragms. Furthermore, good vibration suppression of the housing structure is also achieved along the plane perpendicular to the longitudinal housing plane due to the substantially identical and oppositely directed vibration forces created by the oppositely directed displacement of the deflectable legs along the latter plane.

The deflectable legs may have an inconvenient orientation in some of the previously described embodiments that utilize the common magnet gap for coupling to these to the respective compliant diaphragms. This problem is solved in accordance with a preferred embodiment of the invention where the fixed leg of the first U-shaped armature or the fixed leg of the second U-shaped armature comprises a thoroughgoing hole providing a passage for a drive rod mechanically coupling the deflectable leg of the first U-shaped armature or the deflectable leg of the second U-shaped armature to the first or second compliant diaphragms, respectively.

In several embodiments of the invention, the first and second curved linkage portions are oppositely oriented along the longitudinal housing plane. This means that the first and second curved linkage portions "point" in opposite horizontal directions as illustrated in the vertical (i.e. along the z-axis) cross-sectional views of FIGS. 2C, 5 and 6. In one such embodiment of the invention, the deflectable leg of the first U-shaped armature project into a first magnet gap and the deflectable leg of the second U-shaped armature projects into a second magnet gap. In this embodiment the deflectable legs accordingly project into separate magnet gaps. In one such embodiment, the second U-shaped armature is arranged below the first U-shaped armature in the z-axis direction and, optionally, substantially aligned with the first U-shaped armature along the longitudinal housing plane. The first and second U-shaped armatures are preferably arranged in separate motor assemblies either placed inside separate receiver housings or inside a common housing structure. The first option, allows the moving armature assembly to be manufactured by rigidly fastening the separate receiver housings to each other at appropriate housing walls. In this embodiment, the orientation of the second U-shaped armature relative to the first U-shaped armature may be achieved by mirroring the first U-shaped armature about the longitudinal housing plane and thereafter rotating the second U-shaped armature 180 degrees about the z-axis plane. The first U-shaped armature may additionally be displaced with a predetermined distance along the longitudinal housing plane relative to the second U-shaped armature such that the first and second U-shaped armatures are vertically aligned below each other or displaced horizontally with a certain distance.

In another embodiment where the respective deflectable legs of the first and second U-shaped armatures are arranged in separate magnet gaps, the first magnet gap and the second magnet gap are aligned to each other along the longitudinal housing plane. In addition, the deflectable legs of the first and second U-shaped armatures are both positioned in the longitudinal housing plane, preferably centrally through a middle of each of the first and second magnet gaps. In this embodiment, motor assemblies of the moving armature receiver assembly, including the first and second U-shaped armatures, may be aligned along the longitudinal housing plane. The motor assemblies are preferably arranged within a common receiver housing to provide a compact receiver assembly with low height despite the use of separate magnet gaps for the first and second U-shaped armatures. An advantageous variant of this embodiment comprises a first drive rod coupling a distal end of the deflectable leg of the first U-shaped armature to a first diaphragm. A second drive rod is used for coupling a distal end of the deflectable leg of the second U-shaped armature to a second diaphragm. In this manner, the first and second drive rods may be located in close proximity horizontally (i.e. along the longitudinal housing plane) to provide good suppression of rotational vibration components.

Generally, in embodiments where the deflectable legs of the first and second U-shaped armatures are arranged in separate magnet gaps it may be advantageous to select a relative position between the U-shaped armatures, and their associated motor assemblies, along the longitudinal housing plane such that rotational vibration components or torque components generated by force components acting on the deflectable legs in the perpendicular direction or z-axis direction are minimized or suppressed. This may be achieved by moving a center of gravity of the moving armature receiver assembly into a point where the combined torque component of both motor assemblies is substantially zero. A cancellation of the torque components generated by the first and second motor assemblies may in certain embodiments of the present moving armature receiver assembly be achieved by shifting the positions of the first and second U-shaped armatures away from each other along the longitudinal housing plane such that the first and second U-shaped armatures are only partially overlapping in the orthogonal plane with a predetermined overlap distance as discussed in detail below with reference to FIG. 2C.

In a number of useful embodiments of the invention, the housing structure encloses a shared acoustic front chamber arranged in-between the first diaphragm, which is mechanically coupled to the deflectable leg of the first U-shaped armature, and a second compliant diaphragm which is mechanically coupled to the deflectable leg of the second U-shaped armature.

As previously mentioned, suppression of mechanical vibration along the longitudinal housing plane is according to one set of embodiments of the present moving armature receiver assembly achieved by rotating the first and second U-shaped armatures in opposite directions about the longitudinal housing plane. Consequently, in a preferred embodiment, the first U-shaped armature is positioned such that the first longitudinal armature plane is rotated by a first predetermined angle, or rotational angle, about the longitudinal housing plane and the second U-shaped armature positioned such that the second longitudinal armature plane is rotated by a second predetermined angle, or rotational angle, in opposite direction about the longitudinal housing plane. The first and second predetermined angles are preferably substantially identical and may lie between 2 and 15 degrees, such as between 5 and 10 degrees. The first longitudinal armature plane may for example be rotated by 8 degrees in clockwise direction and the second longitudinal armature plane rotated by 8 degrees in counter clockwise direction (equal to minus 8 degrees) about the longitudinal housing plane. The skilled person will understand these embodiments will provide beneficial vibration suppression of the receiver assembly along the longitudinal housing plane even with minor deviations between the first and second predetermined angles.

In the above-mentioned embodiments, the deflectable legs of the first and second U-shaped armature are preferably configured for oppositely directed displacement along the z-axis plane so as to also suppress vibration of the receiver housing along the z-axis plane. This property may be achieved by selecting appropriate spatial orientation of the first and second U-shaped armatures and/or appropriate directions of the magnetic fields in the separate magnet gaps.

In a number of advantageous embodiments of the invention, the first and second U-shaped armatures have substantially identical dimensions and are made of identical materials. The identical dimension and materials are helpful in providing optimal vibration suppression of the housing structure in the longitudinal housing plane as well as in the orthogonal direction thereto due to the oppositely oriented vibratory motion or displacement of the deflectable legs and the oppositely oriented vibratory motion of the first and second curved linkage portions of the U-shaped armatures. Naturally, further improvement of the vibration suppression may be achieved by matching additional features of the moving armature receiver assembly such as mechanical and acoustical characteristics of the first and second compliant diaphragms, magnetic field strengths in the separate air gaps (if applicable), electrical characteristics of the drive coils, acoustical loads etc.

The moving armature receiver assembly may comprise a first drive coil forming a first coil tunnel and a second drive coil forming a second coil tunnel such that the deflectable leg of the first U-shaped armature extends through the first coil tunnel and the deflectable leg of the second U-shaped armature extends through the second coil tunnel. In other embodiments, the deflectable legs are arranged in a shared coil tunnel of a single drive coil of the receiver assembly.

A third aspect of the invention relates to a moving armature receiver assembly comprising a receiver housing having a longitudinal housing plane; the receiver housing enclosing:

a U-shaped armature comprising a fixed leg and a deflectable leg both extending parallelly to a first longitudinal armature plane and mechanically and magnetically interconnected through a first curved linkage portion and an E-shaped armature comprising fixed legs and a deflectable leg extending parallelly to a second longitudinal armature plane. The first longitudinal armature plane and the second longitudinal armature plane are rotated with respect to each other by a predetermined rotational angle such as between 6 degrees and 14 degrees.

BRIEF DESCRIPTION OF THE DRAWINGS

A preferred embodiment of the invention will be described in more detail in connection with the appended drawings, in which.

DETAILED DESCRIPTION OF PREFERRED EMBODIMENTS

The moving armature receiver assemblies that are described in detail below are specifically adapted for use as miniature receivers or speakers for hearing instruments. However, the novel and inventive vibration suppression features of the disclosed miniature moving armature receiver assemblies may be applied to moving armature receivers tailored for other applications such as portable communication devices and personal audio devices.

Figure 1:
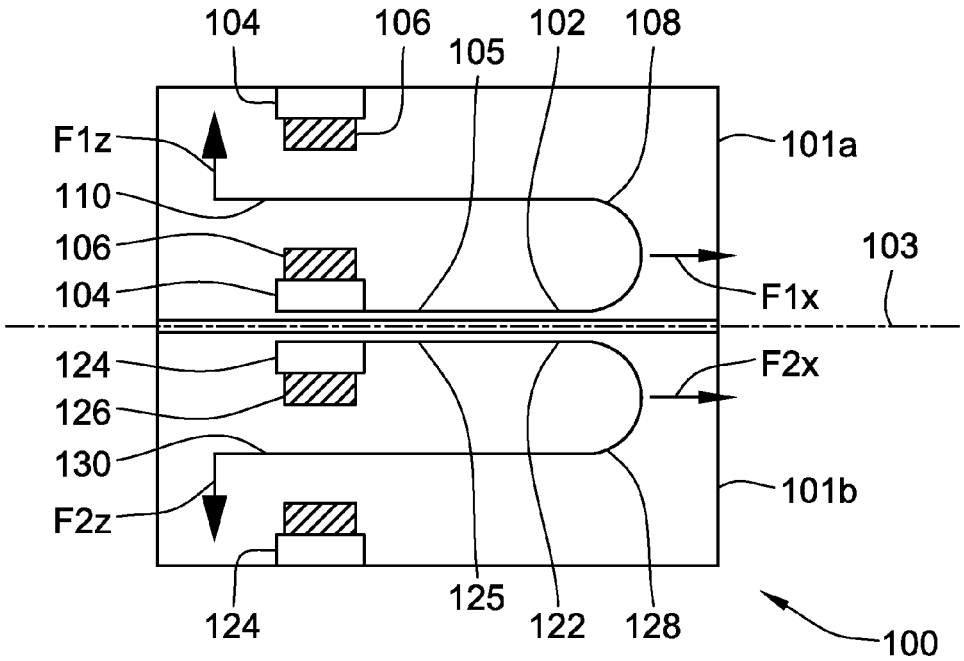
FIG. 1 (PRIOR ART)
FIG. 1 is a schematic cross-sectional view of a prior art dual-receiver based on two U-shaped armatures.

FIG. 1 is a schematic cross-sectional view of a prior art dual-receiver 100 based on two U-shaped armatures 102, 122 enclosed within respective abutted housings 101*a* and 101*b* forming an overall housing structure of the assembly. The housings 101*a* and 101*b* are preferably rigidly coupled to each other through a pair of abutted housing walls for example by welding, soldering, gluing or bonding etc. to form a unitary cohesive housing structure. The cross-sectional view is taken centrally and vertically through the U-shaped armatures 102, 122 relative to a central horizontal housing plane 103 extending through the abutted housing walls of housings 101*a*, 101*b*. The upper and lower portions of the dual-receiver 100 are identical. The upper portion inside housing 101*a* comprises the U-shaped armature 102 which comprises a fixed leg 105 attached to a magnet housing 104. A pair of permanent magnets 106 is magnetically coupled to different sections of the magnet housing 104 and defines a magnet gap through which a deflectable leg 110 of the U-shaped armature 102 extends. The deflectable leg 110 extends substantially parallel to the fixed leg 105. The fixed leg 105 and the deflectable leg 110 are mechanically and magnetically coupled to each other through a curved linkage portion or segment 108 of the U-shaped armature 102. A distant end portion (at or proximate to the depicted force vector F1z) of the deflectable leg 110 is configured for attachment of a drive pin or rod (not shown) for transmission of vibratory motion of the deflectable leg 110 to a compliant receiver diaphragm (not shown) located above the magnet housing 104. The transmitted vibration generates a corresponding sound pressure above the compliant diaphragm and this sound pressure can propagate to a surrounding environment through a suitable sound port or opening (not shown) in the receiver housing structure 101*a*, 101*b*. As illustrated the prior art dual receiver 100 comprises a second or lower portion that is positioned mirror symmetrically about the central horizontal plane 103 extending through the abutted housing walls. The lower portion inside housing 101*b* comprises the U-shaped armature 122 which comprises a fixed leg 125 attached to a magnet housing 124. A pair of permanent magnets 126 is magnetically coupled to different sections of the magnet housing 124 and defines a magnet gap through which a deflectable leg 130 of the U-shaped armature 122 extends. The deflectable leg 130 extends substantially parallel to the fixed leg 125. The fixed leg 125 and the deflectable leg 130 are mechanically and magnetically coupled to each other through a curved linkage portion or segment 128 of the U-shaped armature 122. A distant end portion (at or proximate to the depicted force vector F2z) of the deflectable leg 130 is configured for attachment of a drive pin or rod (not shown) for transmission of vibratory motion of the deflectable leg 130 to a compliant receiver diaphragm (not shown) located above the magnet housing 124.

The identical orientations and dimensions of the upper and lower portions of the dual-receiver 101, including respective U-shaped armatures 102 and 122, means that z-axis displacement and vibration, i.e. vibration along a plane perpendicular to the central longitudinal housing plane 103, of the deflectable legs 110, 130 is oppositely directed as indicated by the oppositely pointing force vectors F1z and F2z. The oppositely directed force vectors created by vibration of the deflectable legs 110, 130 (and compliant diaphragms coupled thereto) lead to suppression or cancellation of a total z-axis vibration of the housing structure formed by the separate receiver housings 101*a*, 101*b*.

However, the curved linkage portions or segments 108, 128 of the U-shaped armatures 102, 122, respectively, are displaced simultaneously, or in phase, in the same direction as indicated by force vector F1x and F2x along the central longitudinal housing plane 103. The in-phase displacement and vibratory motion of the curved linkage segments 108, 128 leads essentially to a doubling of the vibration amplitude of the housing structure along the central longitudinal housing plane 103 compared to a corresponding single receiver, i.e. either the separate receiver within upper receiver housing 101*a* or lower receiver within lower receiver housing 101*b*. Hence, while the depicted prior art mirror symmetrical arrangement or configuration of the upper and lower portions of the dual-receiver 100 may lead to suppression of z-axis vibration, the vibration amplitude is increased instead of suppressed in the perpendicular plane, i.e. along the central horizontal plane 103, or x-axis plane.

Figure 2:
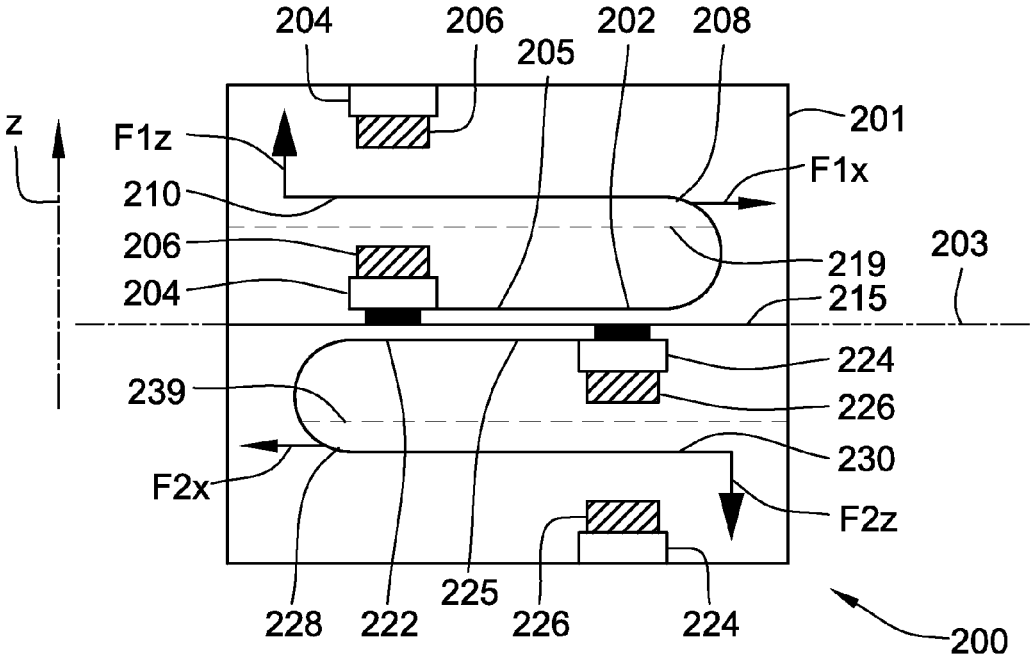
FIG. 2 is a schematic cross-sectional view of a moving armature receiver assembly based on two U-shaped armatures in accordance with a first embodiment of the invention.

FIG. 2 is a simplified schematic cross-sectional view of a moving armature receiver assembly 200 or dual-receiver 200 based on two U-shaped armatures 202, 222 in accordance with a first embodiment of the invention. The dual-receiver 200 comprises two U-shaped armatures 202, 222 enclosed within a shared housing structure 201 separated by a rigid dividing wall 215. These U-shaped armatures 202, 222 may be conventionally fabricated by machining and bending of a single flat piece of ferromagnetic material. In the alternative, the housing structure may be formed by a pair of rigidly fastened separate housings as discussed above in connection with FIG. 1. The cross-sectional view is taken centrally and vertically, i.e. along a z-axis plane of the housing structure 201. While the upper and lower portions of the dual-receiver 100 are substantially identical in terms of dimensions and materials, the lower portion is rotated 180 degree about the z-axis plane compared to the mirror-symmetrical arrangement depicted on the prior art receiver depicted on FIG. 1.

The upper portion comprises the upper U-shaped armature 202 which comprises a fixed leg 205 rigidly attached to a magnet housing 204. A deflectable leg 210 is extending substantially parallel to the fixed leg 205 and both extend parallelly to an upper longitudinal armature plane 219. The fixed leg 205 and the deflectable leg 210 are mechanically and magnetically coupled to each other through a neck 208 or curved linkage portion/segment 208 of the upper U-shaped armature 202. A pair of permanent magnets 206 is magnetically coupled to different sections of the magnet housing 204 and defines a magnet gap through which the deflectable leg 210 of the U-shaped armature 202 projects.

The skilled person will understand that the term "fixed leg" as applied in the present specification does not rule out that a portion of the fixed leg is able to vibrate or be deflected to some extent albeit with a smaller vibration amplitude than the corresponding deflectable leg. Only a limited portion of the fixed leg may be rigidly fastened to the magnet housing as illustrated in FIGS. 2, 3, 5 and 6 or rigidly fastened to another stationary portion of the housing structure.

A distant end portion (located at the depicted force vector F1z) of the deflectable leg 210 is configured for attachment of a drive pin or rod (not shown) for transmission of vibratory motion of the deflectable leg 210 to a compliant receiver diaphragm (not shown) located above the magnet housing 204. The transmitted vibration generates a corresponding sound pressure above the compliant diaphragm and this sound pressure can propagate to a surrounding environment through a suitable sound port or opening (not shown) in the housing structure 201. The distal or distant end portion of the deflectable leg 210 vibrates in accordance with the AC variations of magnetic flux flowing through the U-shaped armature 202. These AC variations of magnetic flux are induced by a substantially corresponding AC drive current in a drive coil (not shown) surrounding at least a portion of the deflectable leg 210. A pair of electrical terminals may be placed on a rear side of the housing structure 201 and electrically connected to the first and second drive coils (not shown). Sound pressure is generated by the dual-receiver 200 by applying an electrical audio signal to the pair of electrical terminals either as an unmodulated (i.e. frequency components primarily situated between 20 Hz and 20 kHz) audio signal or, in the alternative, a modulated audio signal such as a PWM or PDM modulated audio signal that is demodulated by mechanical, acoustical and/or electrical lowpass filtering performed by the dual-receiver 200.

As illustrated, the dual receiver 200 comprises a second or lower half section positioned below a central longitudinal housing plane 203 extending along the horizontal housing wall 215 separating the upper and lower housing portions. The lower section comprises the lower U-shaped armature 222 which comprises a fixed leg 225 attached to a lower magnet housing 224. A deflectable leg 230 is extending substantially parallel to the fixed leg 225 and both extend parallelly to a lower longitudinal armature plane 239. The fixed leg 225 and the deflectable leg 230 are mechanically and magnetically coupled to each other through a neck 228 or curved linkage portion/segment 228 of the lower U-shaped armature 222. A pair of permanent magnets 226 is magnetically coupled to different sections of the magnet housing 224 and defines a second magnet gap through which the deflectable leg 230 of the lower U-shaped armature 222 extends.

The upper and lower longitudinal armature planes 219, 239, respectively, are substantially parallel to each other and parallel to the central longitudinal housing plane 203. The lower half portion of the dual-receiver 200 is arranged in a manner that could be achieved by firstly mirroring the upper half portion about the central longitudinal housing plane 203 and secondly apply a 180 degree rotation of the lower half portion about the z-axis of the housing structure 201. The relative positioning of the upper and lower half portions is such that the first and second curved linkage portions, 208, 228, respectively, are oppositely oriented, or "pointing", in opposite directions along the central longitudinal housing plane 203 as illustrated. This arrangement has the beneficial effect that the curved linkage portions or segments 208, 228 of the U-shaped armatures 202, 222, respectively, are displaced simultaneously in opposite directions along the central longitudinal housing plane 203 or x-axis of the housing structure 201. This means that the curved linkage portions or segments 208, 228 are displaced and vibrate out-of-phase as indicated by force vectors F1x and F2x. Hence, the first and second first U-shaped armatures 202, 222 are configured for suppression of vibration of the housing structure 201 in direction of the central longitudinal housing plane 203. In comparison to the in-phase displacement or motion of the prior art receiver 100 depicted on FIG. 1, the out-of-phase displacement and vibratory motion of the curved linkage segments 208, 228 along the central longitudinal housing plane 203 of the present receiver embodiment 200 lead to a significant suppression of vibration of the housing structure 201 along the central longitudinal housing plane 203. Furthermore, z-axis plane vibration of the housing structure 201, i.e. vibration along a plane perpendicular to the central longitudinal housing plane 203, is suppressed as well by the oppositely directed z-axis motion or vibration of the deflectable legs 210, 230 as indicated by the oppositely pointing force vectors F1z and F2z. The suppression of both x-axis vibration and z-axis vibration is most effective if all relevant dimensions, materials and magnetic properties of the upper and lower portions of the dual-receiver 200, including respective U-shaped armatures 202 and 222, are substantially identical.

Figure 2A:
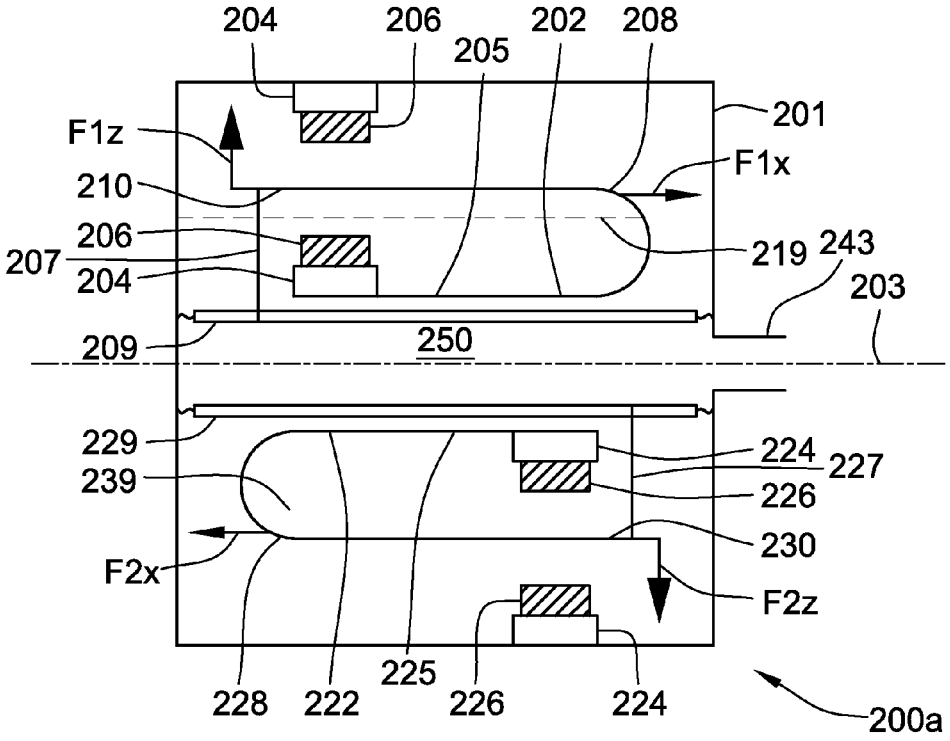
FIG. 2A is a schematic cross-sectional view of a moving armature receiver assembly based on two U-shaped armatures in accordance with a variant of the first embodiment of the invention.

FIG. 2A is a simplified schematic cross-sectional view of a moving armature receiver assembly 200*a* or dual-receiver based on two U-shaped armatures 202, 222 in accordance with a variant of the above-described first embodiment of the invention. Corresponding features have been supplied with the same reference numerals to ease comparison. The dual-receiver 200*a* comprises two U-shaped armatures 202, 222 enclosed within a shared housing structure 201. The upper and lower half portion of the dual-receiver 200*a* is arranged in a manner similar to the arrangement described above in connection with FIG. 2. However, the rigid dividing wall 215 which separates the upper and lower U-shaped armatures 202, 222 and their associated motor systems in the first embodiment has in the present embodiment been eliminated and a shared front volume or chamber 250 is arranged in-between the upper and lower half-potions of the moving armature receiver assembly 200*a*. A sound spout or port 243 is mounted around an opening in the shared housing structure 201 aligned to the front volume or chamber 250 such that sound pressure is transmitted from the front chamber to the outside of the dual-receiver 200*a*. A distant end portion (located proximate to the depicted force vector F1z) of the deflectable leg 210 of the upper U-shaped armature 202 is attached to a drive pin or rod 207 for transmission of vibratory motion of the deflectable leg 210 to an upper or first compliant diaphragm 209 coupled to the front volume or chamber 250 located below the magnet housing 204. The upper compliant diaphragm 209 may be attached to the interior of the shared housing structure 201 by a suitable compliant suspension. The vibration transmitted through the drive pin or rod 207 vibrates the upper compliant diaphragm 209 and generates a corresponding sound pressure in the front volume or chamber 250. In a similar manner, a distant end portion (located proximate to the depicted force vector F2z) of the deflectable leg 230 of the lower U-shaped armature 222 is attached to a lower or second drive pin or rod 227 for transmission of vibratory motion of the deflectable leg 230 to an lower or second compliant diaphragm 229 coupled to the front volume or chamber 250 located above the magnet housing 224 of the lower portion of the dual receiver. The lower compliant diaphragm 229 may also be attached to the interior of the shared housing structure 201 by a suitable compliant suspension. The curved linkage portions or segments 208, 228 of the upper and lower U-shaped armatures 202, 222, respectively, are displaced simultaneously in opposite directions along the central longitudinal housing plane 203, or x-axis, of the housing structure 201. The out-of-phase displacement and vibratory motion of the curved linkage segments 208, 228 along the central longitudinal housing plane 203 lead to a significant suppression of vibration of the housing structure 201 along the central longitudinal housing plane 203. The present embodiment provides a compact dual-receiver structure by the central arrangement of the front-volute 250 inside the shared housing structure 201.

Figure 2B:
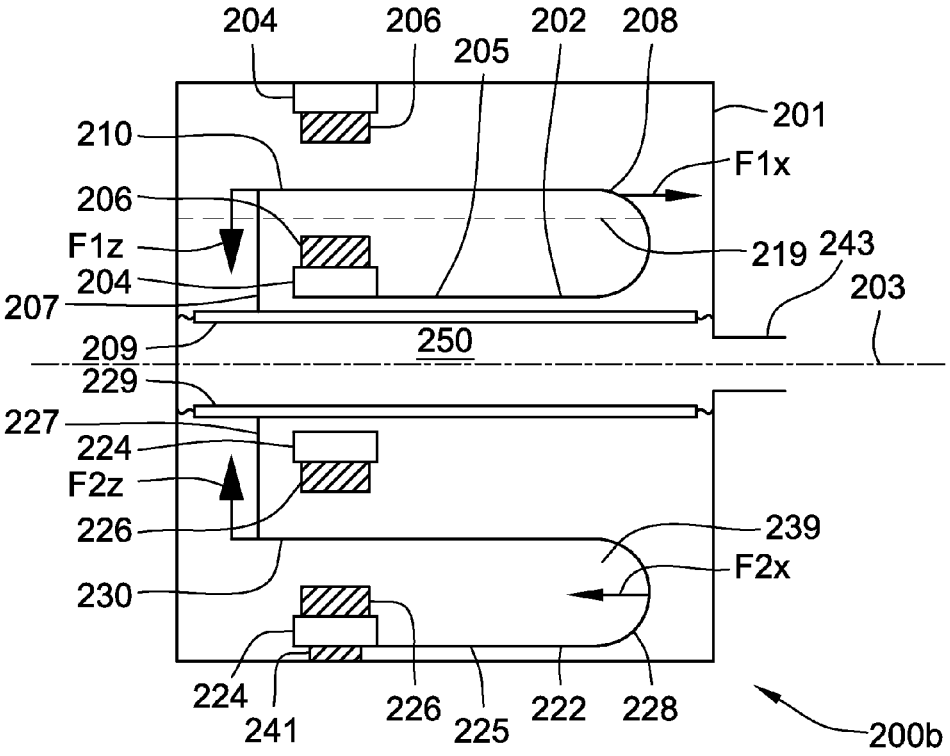
FIG. 2B is a schematic cross-sectional view of a moving armature receiver assembly based on two U-shaped armatures in accordance with a $7^{th}$ embodiment of the invention.

FIG. 2B is a simplified schematic cross-sectional view of a moving armature receiver assembly 200*b* or dual-receiver based on two U-shaped armatures 202, 222 in accordance with a $7^{th}$ embodiment of the invention. Corresponding features of the second embodiment and the present embodiment have been provided with the same reference numerals to ease comparison. The dual-receiver 200*b* comprises two U-shaped armatures 202, 222 enclosed within a shared housing structure 201. The upper and lower half portion of the dual-receiver 200*b* is arranged such that the lower U-shaped armature and its associated motor systems, comprising a pair of permanent magnets 226 magnetically coupled to a magnet housing 224, has been turned upside down, i.e. rotated 180 degrees about the lower longitudinal armature plane 239 compared to the embodiment depicted on FIG. 2A. In this manner, the deflectable leg 230 of the lower U-shaped armature 222 faces a lower compliant diaphragm 229. The deflectable leg 210 of the upper U-shaped armature 202 faces away from the upper compliant diaphragm 209 in a manner similar to the embodiment depicted on FIG. 2A.

A shared front volume or chamber 250 is arranged in-between the upper and lower half-potions of the moving armature receiver assembly 200*b*. A sound spout or port 243 is mounted around an opening in the shared housing structure 201 aligned to the front volume or chamber 250 such that sound pressure is transmitted from the front chamber to the outside of the receiver 200*b*. A distant end portion (located proximate to at the depicted force vector F1z) of the deflectable leg 210 of the upper U-shaped armature 202 is attached to a drive pin or rod 207 for transmission of vibratory motion of the deflectable leg 210 to an upper or first compliant diaphragm 209 coupled to the front volume or chamber 250 located below the magnet housing 204. To provide passage for the drive rod 207 coupled to the deflectable leg 210, a small through going aperture or hole may be provided at suitable location of the fixed leg 205 in case the latter leg protrudes further backward than illustrated. The upper compliant diaphragm 209 may be attached to the interior of the shared housing structure 201 through a suitable compliant suspension. The vibration transmitted through the drive pin or rod 207 vibrates the upper compliant diaphragm 209 and generates a corresponding sound pressure in the front chamber 250. In a corresponding manner, a distant end portion (located proximate to at the depicted force vector F2z) of the deflectable leg 230 of the lower U-shaped armature 222 is attached to a lower or second drive pin or rod 227 for transmission of vibratory motion of the deflectable leg 230 to the lower or second compliant diaphragm 229 acoustically coupled to the front chamber 250 located above the magnet housing 224 of the lower portion of the dual receiver 200*b*. The lower compliant diaphragm 229 may also be attached to the interior of the shared housing structure 201 by a suitable compliant suspension. A small spacer 241 is arranged intermediately between the lower most portion of the magnet housing 224 and the bottom surface of the shared housing structure 201 to avoid rubbing or coupling the lower armature 222 against the bottom surface. The present embodiment provides a compact dual-receiver structure by the central arrangement of the front-volute 250 inside the shared housing structure 201. Furthermore, the drive rod 207 of the upper U-shaped armature and the drive rod 227 of the lower U-shaped armature are substantially aligned vertically, i.e. along the z-axis, to provide enhanced suppression of rotational vibration components induced by z-axis forces from the z-axis vibratory motion of the deflectable legs 210, 230.

Figure 2C:
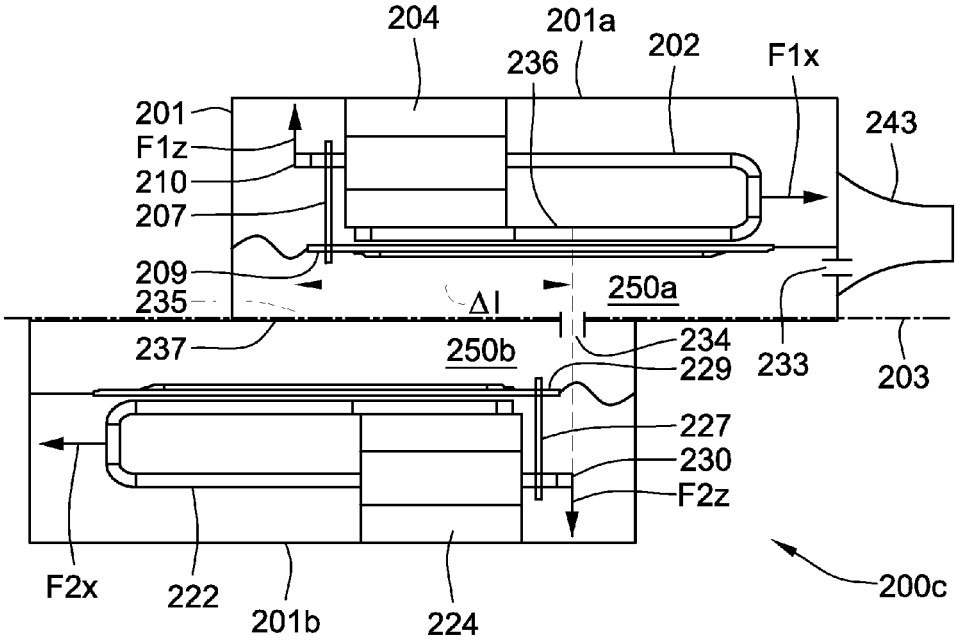
FIG. 2C is a schematic cross-sectional view of a moving armature receiver assembly based on two U-shaped armatures in accordance with an $8^{th}$ embodiment of the invention.

FIG. 2C is a simplified schematic cross-sectional view of a moving armature receiver assembly 200*c* or dual-receiver based on two U-shaped armatures 202, 222 in accordance with an $8^{th}$ embodiment of the invention. Corresponding features of the second embodiment and the present embodiment have been provided with the same reference numerals to ease comparison. The dual-receiver 200*c* comprises two U-shaped armatures 202, 222 enclosed within a shared housing structure 201. In contrast to the $7^{th}$ embodiment discussed above, the shared housing structure 201 of the present embodiment is formed by first and second largely separate housing wall structures 201*a*, 201*b*, respectively, which are shifted away from each other along the longitudinal housing plane 203 with a predetermined distance.

The first housing wall structure 201 a surrounds or encloses the first U-shaped armature 202 and a first compliant diaphragm 209 such that a first front chamber 250*a* is formed above the first compliant diaphragm 209 and a first back chamber below the first compliant diaphragm. Likewise, the second housing wall structure 201*b* is surrounding the second U-shaped armature 222 and second compliant diaphragm 229 such that a second front chamber 250*b* is formed above the second compliant diaphragm 229 and a second back chamber below the second compliant diaphragm 229. A distant end portion (located proximate to at the depicted force vector F1z) of the deflectable leg 210 of the upper or first U-shaped armature 202 is attached to a drive pin or rod 207 for transmission of vibratory motion of the deflectable leg 210 to an upper or first compliant diaphragm 209 coupled to the front volume or chamber 250 located below the magnet housing 204. The upper compliant diaphragm 209 may be attached to the interior of the shared or common housing structure 201 through a suitable compliant suspension as illustrated. The vibration transmitted through the drive pin or rod 207 vibrates the upper compliant diaphragm 209 and generates a corresponding sound pressure in the first or upper front chamber 250*a*. In a corresponding manner, a distant end portion (located proximate to at the depicted force vector F2z) of the deflectable leg 230 of the lower U-shaped armature 222 is attached to a lower or second drive pin or rod 227 for transmission of vibratory motion of the deflectable leg 230 to the lower or second compliant diaphragm 229 acoustically coupled to the second front chamber 250*b* located above the magnet housing 224 of the lower portion of the dual receiver 200*c*. The lower compliant diaphragm 229 may also be attached to the interior of the shared housing structure 201 by a suitable compliant suspension.

The first and second magnet housings 204, 224, respectively, are rigidly attached or fixed to the housing structure 201. This may be accomplished in several ways for example as depicted in the present embodiment where a plane surface of the first magnet housing 204 is rigidly attached to an upper inner wall of the housing wall structure 201 a and a first plane surface of the second magnet housing 224 is rigidly attached to a lower inner wall of the second or lower housing wall structure 201*b*. The respective fixed legs of the first and second U-shaped armatures 202, 222 may be attached directly or indirectly to the housing structure 201 is numerous ways. The fixed leg of the first U-shaped armature 202 may be rigidly attached to a second surface of the first magnet housing 204 arranged oppositely to the first surface of the first magnet housing. Likewise, the fixed leg of the second U-shaped armature 222 may be rigidly attached to a second surface of the second magnet housing 224 arranged oppositely to the first surface of the first magnet housing.

The first and second U-shaped armatures 202, 222 are also shifted away from each other along the longitudinal housing plane 203 due to the corresponding horizontal shift of the first and second housing wall structures 201*a*, 201*b*, respectively, such that the first and second U-shaped armatures 202, 222 are only partially overlapping in the orthogonal plane extending perpendicularly to the longitudinal housing plane 203. The first and second U-shaped armatures 202, 222 are overlapping with predetermined overlap distance illustrated by symbol Δl extending between vertical marker lines 235, 236 on the drawing.

The above-discussed shifted arrangement of first and second U-shaped armatures 202, 222 is different from the previously discussed $2^{nd}$ and $7^{th}$ embodiments of the present moving armature receiver assembly where the first and second U-shaped armatures 202, 222 are completely overlapping in the orthogonal plane, i.e. the U-shaped armatures are placed directly below each other. The predetermined overlap distance Δl may correspond to between 20% and 60%, even more preferably between 25% and 40%, of a length of the first U-shaped armature. The dimensions of the first and second U-shaped armatures 202, 222 are preferably identical. The first and second front chambers 250*a*, 250*b* are acoustically coupled to each other via an acoustic aperture 203 extending through abutted and overlapping portions 237 of the first and second housing wall structures. The abutted and overlapping portions 237 of the first and second housing wall structures may comprise a single shared wall structure or two separate, but adjacent or abutted wall portions of the first and second housing wall structures. The acoustic coupling of the first and second front chambers 250*a*, 250*b* make these function largely as a shared acoustic front chamber of the receiver assembly 200*c*. The shared acoustic front chamber is acoustically coupled or connected to the external environment outside the housing structure 201 via a shared sound port or aperture 233 formed in the first housing wall structures 201*a* leading into first front chamber 250*a*. The sound port or aperture 233 may be surrounded by a spout 243. In this manner, the first front chamber 250*a* is directly coupled to the sound port 233 while the second front chamber 250*b* is merely indirectly coupled to the sound port 233 through the first front chamber 250*a*. The skilled person will appreciate that the acoustic aperture 203 may be much larger than illustrated by FIG. 2C and extend through the entirety of the adjacent or abutted wall portions 237 of the first and second housing wall structures to form an unrestricted shared front chamber.

The skilled person will understand that respective torques caused by the action of armature forces F1x, F2x and F1z, F2z and diaphragm displacements of the present moving armature receiver assembly 200*c* will have different (effective) distances from a mass center of the assembly 200*c*. By choosing the predetermined overlap distance or horizontal shift of the first and second U-shaped armatures 202, 222 carefully, the rotational forces associated with F1x, F2x and F1z, F2z force components are in opposite rotational directions and largely cancel out.

Figure 3:
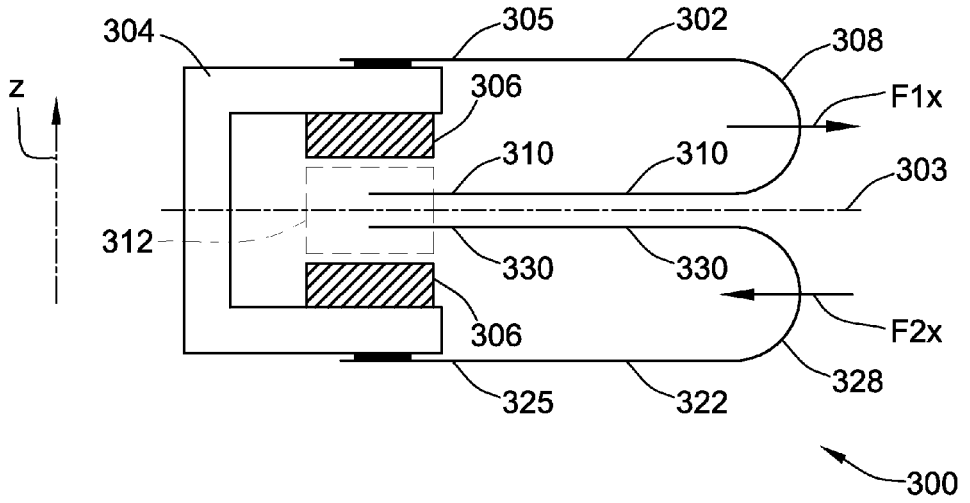
FIG. 3 is a schematic cross-sectional view of a moving armature receiver assembly based on two U-shaped armatures sharing a common magnet gap in accordance with a second embodiment of the invention.

FIG. 3 is a simplified schematic cross-sectional view of a moving armature receiver assembly or dual-receiver 300 based on two U-shaped armatures 320, 322 sharing a common magnet gap 312 in accordance with a second embodiment of the invention. The cross-sectional view is taken centrally and vertically, i.e. along a z-axis plane indicated by dotted arrow "z" of a housing structure in form of a shared receiver housing (not shown). The dual-receiver 300 comprises an upper U-shaped armature 302 and a lower U-shaped armature 322 enclosed within the shared receiver housing (not shown). A magnet housing 304 is operatively fastened to the shared receiver housing. The upper and lower U-shaped armatures 302, 322 may be conventionally fabricated by machining and bending of a single flat piece of ferromagnetic material. The upper and lower U-shaped armatures 302, 322 are arranged mirror symmetrically about a central longitudinal housing plane 303. The upper and lower U-shaped armatures 302, 322, respectively, are preferably substantially identical in terms of dimensions and materials. The upper U-shaped armature 302 comprises a fixed leg 305 attached to the magnet housing 304. A deflectable leg 310 is extending substantially parallel to the fixed leg 305. The fixed leg 305 and the deflectable leg 310 are mechanically and magnetically coupled to each other through a neck 308 or curved linkage portion/segment 308 of the U-shaped armature 302. A distant end portion of the deflectable leg 310 is located within a common magnet gap 312. The common magnet gap 312 is formed between opposing surfaces of a pair of permanent magnets 306 which creates a magnetic field of suitable strength within the common magnet gap 312. The lower U-shaped armature 322 likewise comprises a fixed leg 325 attached to the magnet housing 304. A deflectable leg 330 is extending substantially parallel to the fixed leg 325. The fixed leg 305 and the deflectable leg 310 are mechanically and magnetically coupled to each other through a neck 328 or curved linkage portion/segment 328 of the lower U-shaped armature 322. A distant end portion of the deflectable leg 330 is located within the common magnet gap 312. As illustrated, the deflectable legs 310, 330 of the upper and lower U-shaped armatures 302, 322, respectively, are arranged substantially parallelly to each other and parallelly to the central longitudinal housing plane 303 only separated by a small air gap. The mirrored arrangement of the upper and lower U-shaped armatures 302, 322, respectively, in combination with the common magnet gap 312 mean the deflectable legs 310 and 330 are displaced simultaneously in the same z-axis direction. Therefore, both of the deflectable legs 310, 330 are preferably coupled to a compliant diaphragm (not shown) for sound generation. Both of the deflectable legs 310, 330 preferably extend through a common coil tunnel of a shared drive coil.

The curved linkage portions 308, 328 of the upper and lower U-shaped armatures 302, 322, respectively, are displaced simultaneously in opposite directions, or out-of-phase, along the central longitudinal housing plane 303 as indicated by force vectors F1x and F2x. Hence, while the upper U-shaped armature 302 "closes" and hence displaces the curved linkage portions 308 in the direction indicated by force vectors F1x the lower U-shaped armature 322 "opens" and displaces the curved linkage portions 328 in the opposite direction indicated by force vectors F2x. Consequently, similarly to the previously described first embodiment of the invention, the first and second first U-shaped armatures 302, 322, respectively, are configured for suppression of vibration of the receiver housing along the central longitudinal housing plane 303 or along the x-axis plane.

Because of the in-phase displacement of the deflectable legs 310, 330 along the z-axis plane these legs are preferably mechanically coupled to a single shared compliant receiver diaphragm (not shown) by respective drive pins or rods (not shown) for transmission of vibratory motion to the compliant receiver diaphragm as mentioned above. Each of the drive pins or rods may for example be arranged in a middle section of respective ones of the displaceable legs 310, 330 since the distal end portions are located within the common magnet gap 312. One advantage of the present dual-receiver design 300, in comparison to the dual-receiver embodiment described above in connection with FIG. 2, is the possibility to position the drive pin or rods close to each other along the central housing plane 303 and thereby reduce any rotational vibration components induced by z-axis forces caused by the vibratory motion of the deflectable legs 310, 330.

Figure 4:
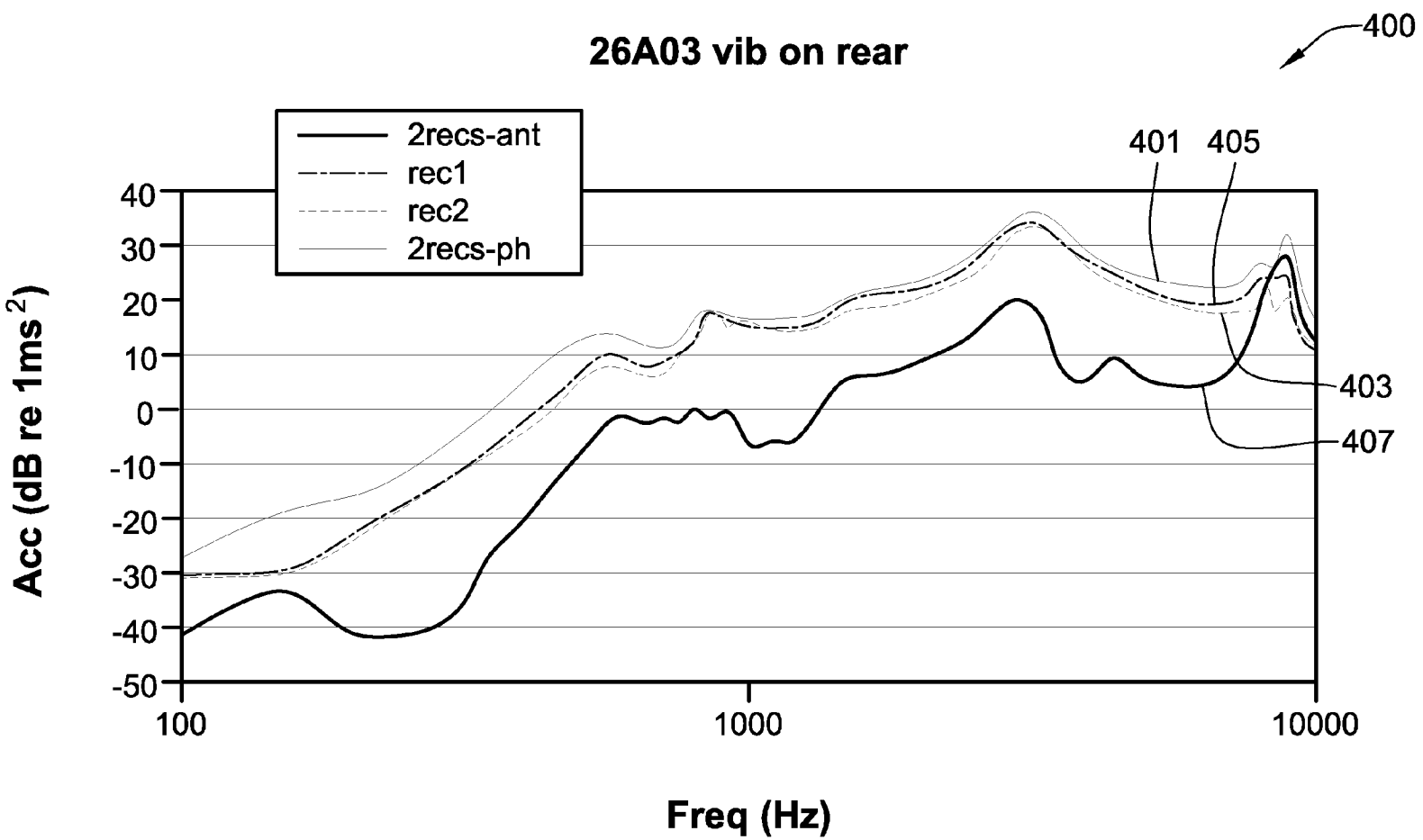
FIG. 4 is a graph of experimentally measured vibration amplitudes versus frequency for an experimental version of the moving armature receiver assembly depicted on FIG. 2 in comparison to a corresponding single armature receiver.

FIG. 4 is a graph 400 of experimentally measured vibration forces versus frequency for an experimental version of the moving armature receiver assembly 200 depicted on FIG. 2 in comparison to a conventional or prior art moving armature receiver 100 as depicted on FIG. 1. The measured vibration force depicted on curve 407 is for the novel moving armature receiver assembly 200 when measured on the housing structure 201 in direction of the longitudinal housing plane 203 or x-axis plane in the audio frequency range between 100 Hz and 10 kHz. The corresponding measured vibration amplitude measured on the housing 101 of the conventional moving armature receiver 100 is depicted on curve 401. Finally, the measured vibration amplitude on each of the separate receiver housings that forms the conventional dual-receiver is depicted on curves 403 and 405. As illustrated, the vibration force or acceleration on the housing of the moving armature receiver assembly 200 in accordance with the present invention is overall about 12-20 dB lower than the corresponding vibration force on the housing 101 of the conventional moving armature receiver 100.

Figure 5:
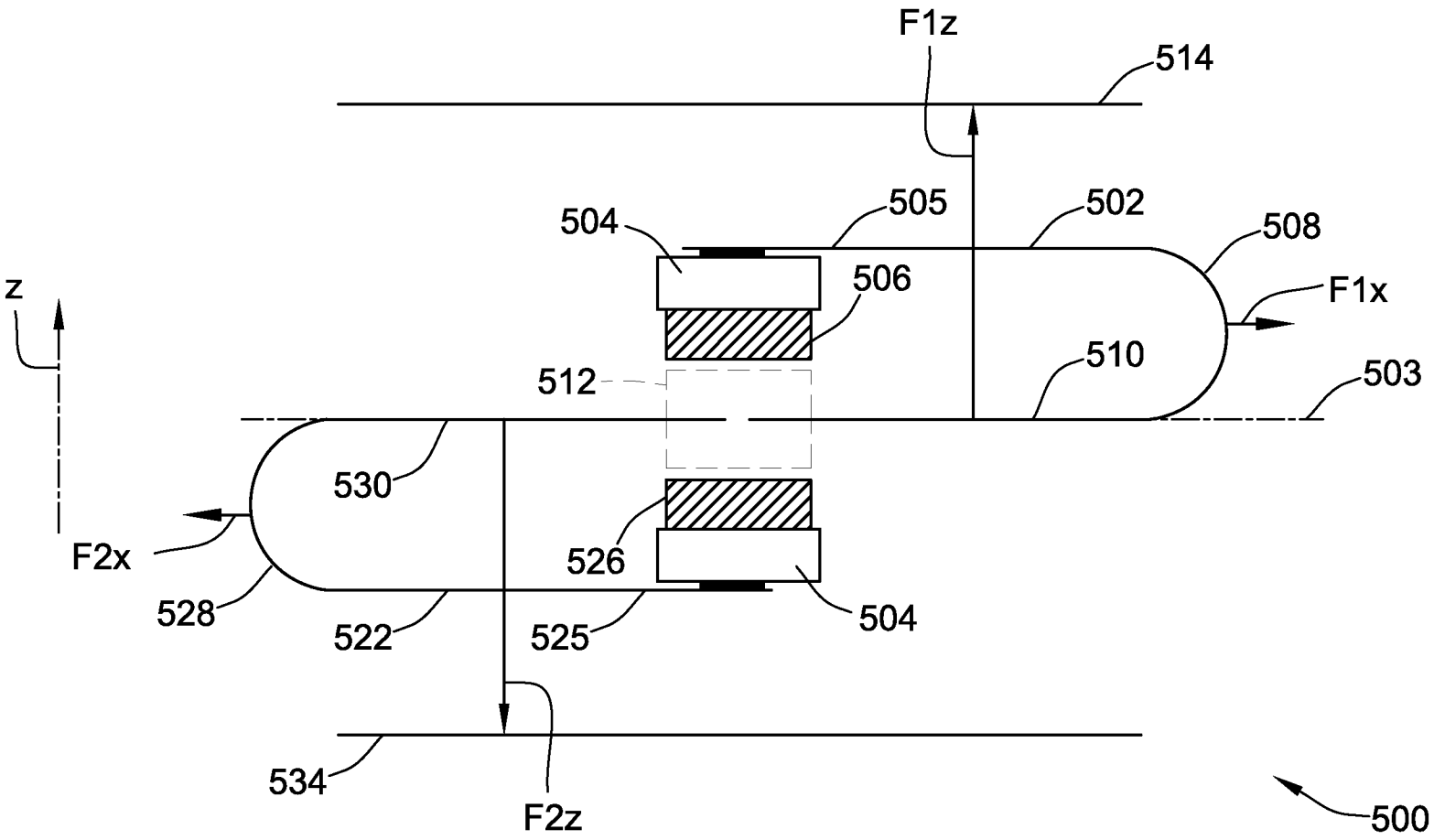
FIG. 5 is a schematic cross-sectional view of a moving armature receiver assembly based on two U-shaped armatures sharing a common magnet gap in accordance with a third embodiment of the invention.

FIG. 5 is a simplified schematic cross-sectional view of a dual-receiver based on two U-shaped armatures 502, 522 sharing a common magnet gap 512 in accordance with a third embodiment of the invention. The depicted cross-sectional view is taken centrally and vertically, i.e. along a z-axis plane extending as indicated by dotted arrow "z", of a shared receiver housing (not shown) through the U-shaped armatures 502, 522. The dual-receiver 500 comprises an upper U-shaped armature 502 and a lower U-shaped armature 522 enclosed within the shared receiver housing (not shown). The upper and lower U-shaped armatures 502, 522 may be conventionally fabricated by machining and bending of a single flat piece of ferromagnetic material. The common magnet gap 512 is formed between a pair of permanent magnets 506, 526 which creates a magnetic field within the common magnet gap 512. The upper U-shaped armature 502 comprises a fixed leg 505 attached, and magnetically coupled, to a magnet housing 504 which in turn may be rigidly fastened to a stationary portion of shared receiver housing (not shown). A deflectable leg 510 extends substantially parallel to the fixed leg 505. The fixed leg 505 and the deflectable leg 510 are mechanically and magnetically coupled to each other through a neck 508 or curved linkage portion/segment 508 of the U-shaped armature. The lower U-shaped armature 522 likewise comprises a fixed leg 525 attached, and magnetically coupled, to the magnet housing 504. A deflectable leg 530 extends substantially parallel to the fixed leg 525. The fixed leg 505 and the deflectable leg 510 are mechanically and magnetically coupled to each other through a neck 528 or curved linkage portion/segment 528 of the lower U-shaped armature. The upper U-shaped armature 502 is coupled to a first compliant diaphragm 514 arranged above the magnet housing 504 through a drive pin or rod (not shown) mechanically coupled to the deflectable leg 510 for example at the position indicated by the depicted force vector F1z. Likewise, the deflectable leg 530 of the lower armature 522 is mechanically coupled to a second compliant diaphragm 534 arranged below the magnet housing 524 through a drive pin or rod (not shown). The drive rod may for example be positioned at the position indicated by the depicted force vector F2z. To provide passage for the drive rods, small through going apertures or holes may be provided at suitable locations of the fixed leg 505 and the fixed leg 525.

In the present embodiment, the upper and lower U-shaped armatures 502, 522 have substantially identical dimensions. The respective deflectable legs 510, 530 of the upper and lower U-shaped armatures 502, 522 project into the common magnet gap 512 and are aligned with each other in a central longitudinal housing plane 503. The deflectable legs 510, 530 are accordingly placed in non-overlapping manner in the z-axis direction extending perpendicularly to a central longitudinal housing plane 503 as indicated by dotted arrow "z". Furthermore, the deflectable legs 510, 530 preferably project or extend a similar distance into the common magnet gap 512. Consequently, the magnetic forces acting on the deflectable legs 510, 530 of the upper and lower U-shaped armatures, respectively, are largely identical and create substantially identical but oppositely directed simultaneous displacement of the deflectable legs 510, 530 along the z-axis plane as indicated by the oppositely pointing force vectors F1z and F2z. The suppression of z-axis vibratory motion of the housing structure can be improved if the first and second compliant diaphragms 514, 534 are matched so as to possess substantially identical mechanical and acoustical characteristic as well.

The arrangement of the upper and lower U-shaped armatures 502, 522 in combination with the common magnet gap 512 mean that the displaceable legs 510 and 530 move simultaneously in opposite z-axis directions as mentioned above. Thereby, the curved linkage portions 508, 528 of the U-shaped armatures 502, 522, respectively, are displaced simultaneously in opposite directions, or out-of-phase, along the central longitudinal housing plane 503 as indicated by force vectors F1x and F2x. Consequently, similarly to the previously described embodiments of the invention, the upper and lower U-shaped armatures 502, 522, respectively, are configured for suppression of vibration of the receiver housing along the central longitudinal plane 503.

Figure 6:
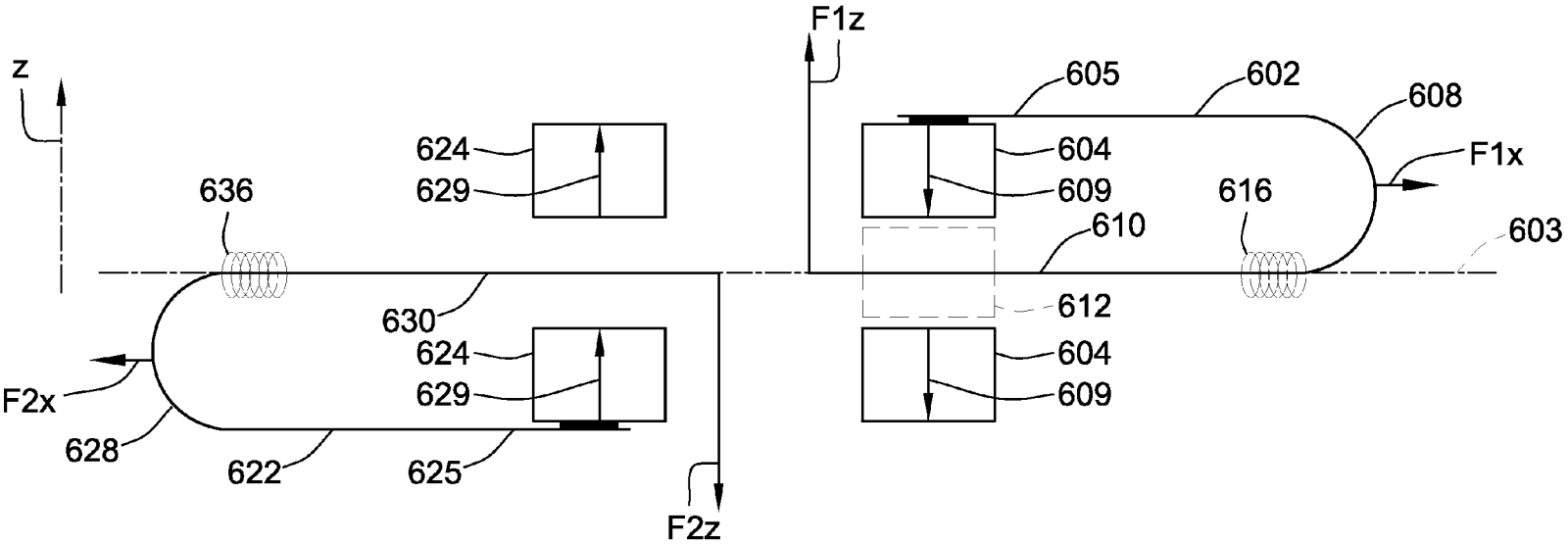
FIG. 6 is a schematic cross-sectional view of a moving armature receiver assembly based on two U-shaped armatures arranged in separate magnet gaps in accordance with a fourth embodiment of the invention.

FIG. 6 is a schematic cross-sectional view of a moving armature receiver assembly 600 or dual-receiver 600 based on two U-shaped armatures 602, 622 arranged in separate magnet gaps in accordance with a fifth embodiment of the invention. The dual-receiver 600 comprises an upper and a lower U-shaped armature 602, 622, respectively, enclosed within a common receiver housing (not shown). These U-shaped armatures 602, 622 may be conventionally fabricated by machining and bending of a single flat piece of ferromagnetic material. The cross-sectional view is taken centrally and vertically, i.e. along a z-axis plane (indicated by the vertical dotted arrow) of the receiver housing through the upper and lower U-shaped armatures 602, 622. As illustrated, the present dual-receiver 600 uses two separate magnet houses 604, 624 enclosing respective pairs of permanent magnets that are magnetized in opposite direction (as schematically indicated by magnetic flux vectors 609 and 629) to suppress AC magnetic flux generated by the upper and lower U-shaped armatures 602, 622 in a far field of the common receiver housing. Each of the permanent magnets and its associated magnet house is depicted as a single magnet unit 604, 624 in the schematic drawing for simplicity. The upper U-shaped armature 602 comprises a fixed leg 605 attached to the upper magnet housing 604. A deflectable leg 610 extends substantially parallelly to the fixed leg 605. The fixed leg 605 and the deflectable leg 610 are mechanically and magnetically coupled to each other through a neck 608 or curved linkage portion/segment 608 of the U-shaped armature. The lower U-shaped armature 622 likewise comprises a fixed leg 625 attached to a housing of the lower magnet unit 624. A deflectable leg 630 extends substantially parallel to the fixed leg 625. The fixed leg 605 and the deflectable leg 610 are mechanically and magnetically coupled to each other through a neck 628 or curved linkage portion/segment 628 of the lower U-shaped armature 622. Furthermore, the deflectable and fixed legs 610, 605 of the upper U-shaped armature and the deflectable and fixed legs 630, 655 of the lower U-shaped armature 622 all extend substantially parallelly to a central longitudinal housing plane 603.

A gap portion of the deflectable leg 610 is situated in the upper magnet gap 612 extending between opposing surfaces of the magnet unit 604. The deflectable leg 610 of the upper armature 602 is mechanically coupled to a first compliant diaphragm (not shown) arranged above the upper half of the permanent magnet/magnet housing 604 through a drive pin or rod (not shown) for example positioned as indicated by the depicted force vector F1z. Likewise, the deflectable leg 630 of the lower armature 622 is mechanically coupled to a second compliant diaphragm (not shown) arranged below the permanent magnet/magnet housing 624 through another drive pin or rod (not shown). This drive rod may for example be fastened to a distal end portion of the deflectable leg 630 as indicated by the depicted force vector F2z.

The deflectable leg 610 of the upper armature 602 extends centrally through a coil tunnel formed by an upper drive coil 616 and the deflectable leg 630 of the lower armature 622 extends centrally through another coil tunnel formed by a lower drive coil 636. A pair of electrical terminals may be placed on a suitable location of the receiver housing and electrically connected to the upper and lower drive coils (not shown) to supply audio or AC drive current to the drive coils 616, 636 as previously mentioned. The AC drive current creates a correspondingly alternating or AC magnetic flux through the upper and lower U-shaped armatures 602, 622.

Compared to the previous dual-receiver construction 500 described above, the present embodiment of the dual-receiver 600 allows the drive pins or rods to be situated substantially below each other, i.e. at the same position along the central longitudinal housing plane 603. The aligned arrangement of the drive rods in vertical direction suppress z-axis vibration of the receiver housing and also suppress rotational vibration components or torque due to a very small offset along the x-axis plane between the drive rod positions. The placement of the magnet units 604, 624 creates a maximum flux potential at a middle section of the two magnet houses but this can be shielded by extra magnetic shielding and/or coupling of the two magnet houses by holes for the drive pins.

The oppositely directed magnetic fluxes in the upper and lower permanent magnets/magnet houses 604, 624, respectively, has the beneficial effect that the curved linkage portions or segments 608, 628 of the U-shaped armatures 602, 622, respectively, are displaced simultaneously in opposite directions along the central longitudinal housing plane 603. This means that the curved linkage portions or segments 608, 628 are displaced and vibrate out-of-phase as indicated by force vectors F1x and F2x. Hence, the first and second first U-shaped armatures 602, 622 are configured for suppression of vibration of the receiver housing along the central longitudinal housing plane 603. The suppression of both x-axis vibration and z-axis vibration is most effective if all relevant dimensions, materials and magnetic properties of the upper and lower portions of the dual-receiver 600, including respective U-shaped armatures 602 and 622, are substantially identical or matched.

Figure 7A:
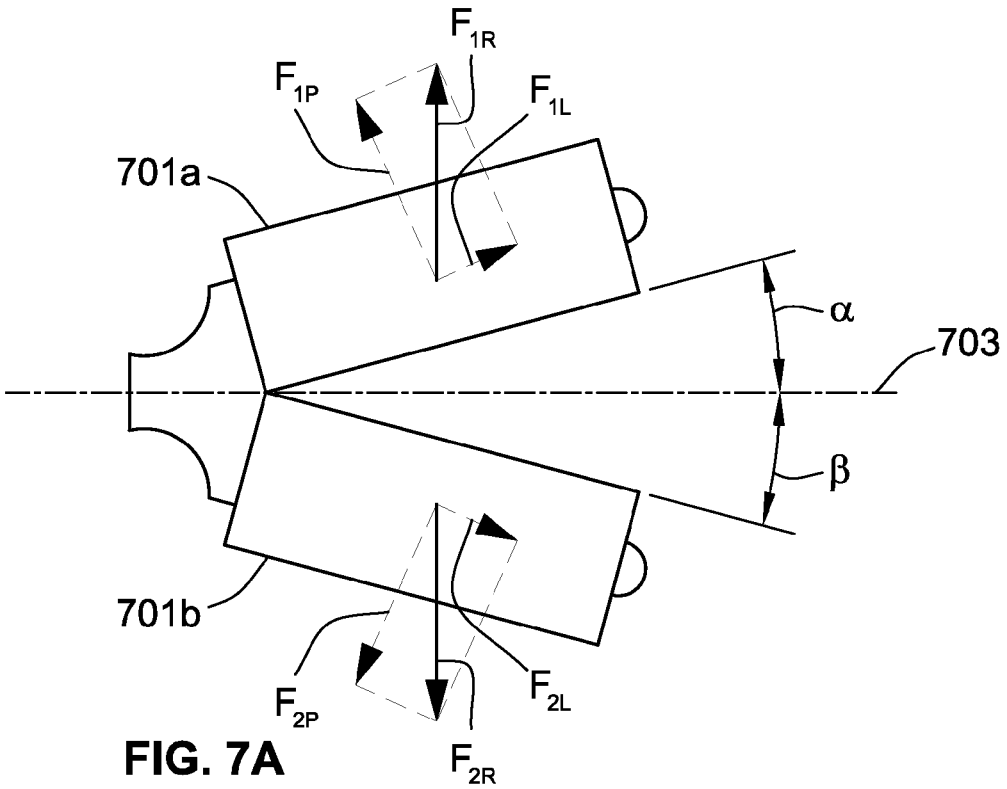
FIG. 7A is conceptual illustration of a moving armature receiver assembly that comprises a pair of receiver housings rotated in opposite directions about a central longitudinal housing plane to illustrate vibration suppression concepts exploited in a fifth embodiment of the invention.

FIG. 7A is conceptual illustration of a moving armature receiver assembly 700 that comprises a housing structure comprising a pair of receiver housings 701*a* and 701*b* rotated in opposite directions about a central longitudinal housing plane 703 to illustrate vibration suppression concepts exploited in a fifth embodiment of the invention.

Generally, the use of a U-shaped armature in moving armature receiver causes vibration force components to be created in a longitudinal armature plane along the fixed and deflectable legs and a vibration force component in the perpendicular plane (e.g. z-axis plane). These two force components (longitudinal and perpendicular) can be considered as proportional in a wide range of the audio frequency range. In this wide range the ratio between perpendicular and longitudinal vibration force components is mainly determined by a height to length ratio of the U-shaped armature. A constant ratio between the perpendicular (z-axis) force component and the longitudinal force component at the armature leads to a resulting force component, which has a certain angle to the U-shaped armature. This analysis leads to the insight that a "vibration cancelled" or vibration suppressed moving armature receiver assembly can be constructed by using 2 separate U-shaped armatures if the U-shaped armatures are rotated about the longitudinal housing plane in such a way the resulting force components of both U-shaped armatures lie on the same axis but are opposite in direction. This can be achieved by adapting respective angles of rotation of the U-shaped armatures (and thereby their respective longitudinal armature planes extending in parallel to the fixed and deflectable legs) relative to a longitudinal housing plane to dimensions of the U-shaped armatures in question.

Dependent on design characteristics of motor assemblies surrounding each of the U-shaped armatures, at least two different types of armature rotation is possible to create different embodiments of the invention: In a first embodiment, each of the deflectable legs of the U-shaped armatures projects towards a compliant diaphragm or speaker diaphragm as illustrated on FIG. 8A. In a second embodiment, the deflectable legs of the U-shaped armatures projects away from the compliant diaphragm or speaker diaphragm as illustrated on FIG. 8B.

In the conceptual illustration of FIG. 7A, an upper U-shaped armature is arranged within the upper receiver housing 701*a* in a manner where a fixed leg and a deflectable leg of the upper U-shaped armature extend parellelly to each other, along an upper longitudinal armature plane, and parallelly to the housing walls of the upper receiver housing 701 a. Likewise, a lower U-shaped armature is arranged within the lower receiver housing 701*b* in a manner where a fixed leg and a deflectable leg of the lower U-shaped armature extend parellelly to each other, along an lower longitudinal armature plane, and parallelly to the housing walls of the lower receiver housing 701*b*. The upper receiver housing 701*a* is rotated counter clock wise by a first rotational angle, a, about the central longitudinal housing plane 703. The lower receiver housing 701*b* is rotated oppositely, i.e. clock wise in this example, by a second rotational angle, β, about the central longitudinal housing plane 703. The first rotational angle, α, is preferably set substantially equal in magnitude to the second rotational angle, β. In a number of preferred embodiments, a is set to between 2 and 15 degrees, preferably between 5 and 10 degrees, and β therefore set to a value between −2 and −15 degrees, preferably between −5 and −10 degrees. The oppositely rotated placement of the upper and lower U-shaped armatures about the central longitudinal housing plane 703 leads to the beneficial creation of oppositely directed resulting force components and thereby suppression of mechanical vibration of the receiver housings 701*a*, 701*b* as explained above with reference to FIGS. 8A and 8B. The role of the illustrated force components $F_{1P}$, $F_{1L}$, and $F_{1R}$ as well as $F_{2P}$, $F_{2L}$, and $F_{2R}$ is explained in detail below in connection with FIG. 8A).

Figure 7B:
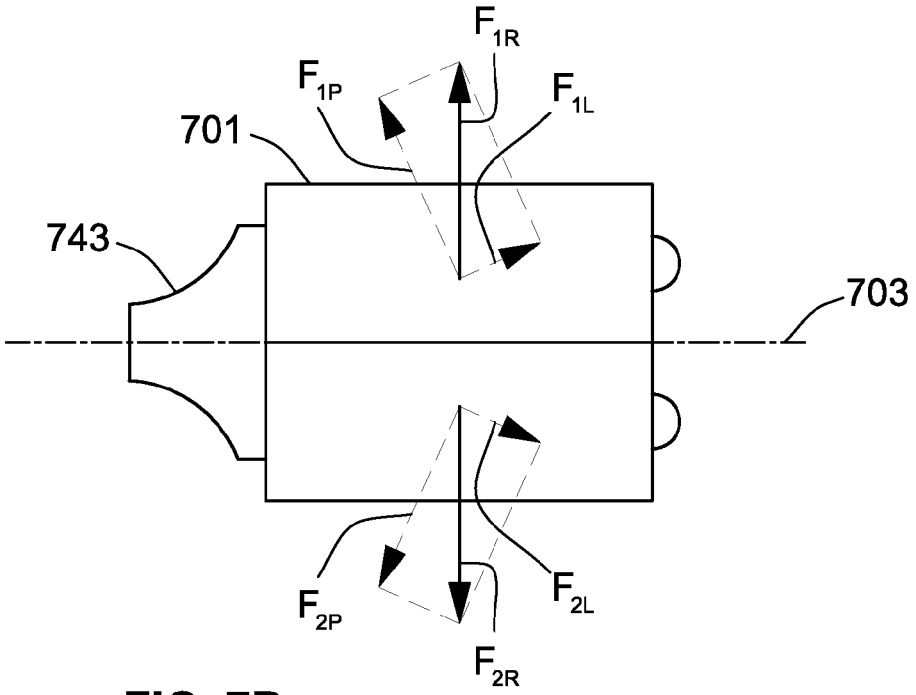
FIG. 7B is a simplified schematic view of a practical moving armature receiver assembly in accordance with the fifth embodiment of the invention.

FIG. 7B is a simplified schematic view of a practical moving armature receiver assembly 700 enclosed with a housing structure 701 in accordance with the fifth embodiment of the invention. The moving armature receiver assembly 700 comprises a pair of U-shaped armatures as described above in connection with FIG. 7A). The upper and lower U-shaped armatures are rotated in opposite directions about the central longitudinal housing plane 703 by the rotational angles described above which means that the U-shaped armatures and their associated motor assemblies are tilted within the housing structure 701 for example in a construction as schematically illustrated on FIG. 8A) below. A sound port or spout 743 is acoustically coupled to a front chamber of the housing structure 703 to transmit sound pressure therein to a surrounding environment.

Figure 8A:
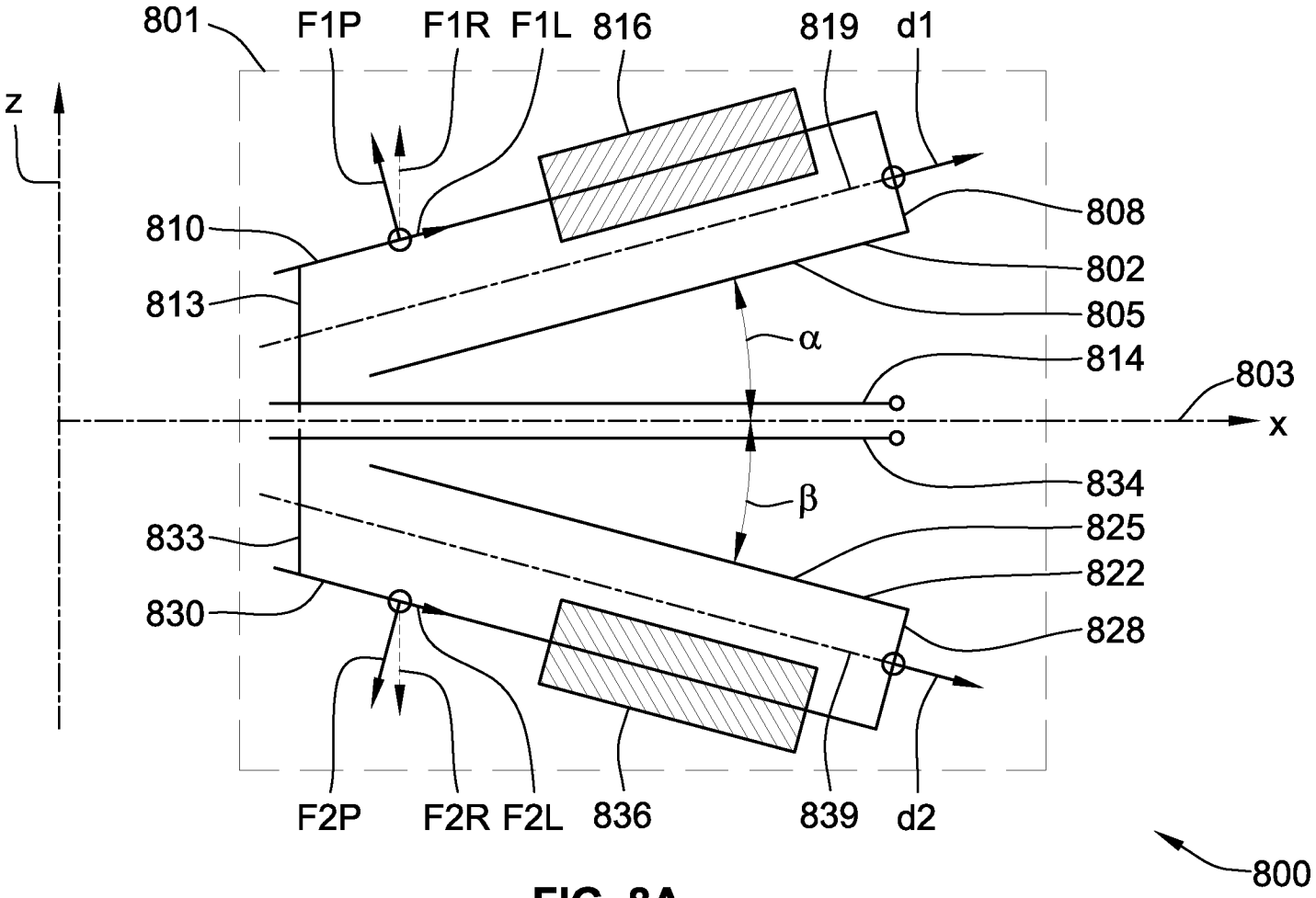
FIG. 8A is simplified schematic illustration of respective forces acting on two U-shaped armatures rotated in opposite directions about a central longitudinal housing plane according to the $5^{th}$ embodiment of the invention.

FIG. 8A is simplified schematic illustration of forces acting on a pair of U-shaped armatures 802, 822 rotated in opposite directions about a longitudinal housing plane 803, which in this case may be a central longitudinal housing plane, and arranged inside a housing structure comprising a common receiver housing 801. The moving armature receiver assembly 800 is a schematic cross-sectional view along a perpendicular or vertical plane (z-axis plane) extending perpendicularly to the central longitudinal housing plane 803 (x-axis plane). The moving armature receiver assembly 800 comprises a common receiver housing 801 enclosing both the upper and lower upper U-shaped armatures 802,822 arranged in respective motor assemblies (not shown in detail other than drive coils 816, 836). A fixed leg 805 and a deflectable leg 810 of the upper U-shaped armature 802 extend substantially parellelly to each other, along a first or upper longitudinal armature plane 819. Likewise, a fixed leg 825 and a deflectable leg 830 of the lower U-shaped armature 822 extend substantially parellelly to each other, along a second or lower longitudinal armature plane 839. An upper curved linkage portion 808, or neck, interconnects the fixed leg 825 and the deflectable leg 830 mechanically and magnetically. A lower curved linkage portion 828, or neck, likewise interconnects the fixed leg 825 and the deflectable leg 830 mechanically and magnetically. This orientation of the necks 808, 828 of the upper and lower U-shaped armatures 802, 822, respectively, means these are displaced simultaneously in slightly angled directions relative the central longitudinal housing plane 803 as indicated by the depicted movement arrows d1 and d2.

The upper U-shaped armature 802 is rotated counter clock wise by a first rotational angle, α, about the central longitudinal housing plane 803. The lower U-shaped armature 822 is rotated oppositely, i.e. clock wise in this example, by a second rotational angle, β, about the central longitudinal housing plane 803. The respective motor assemblies are preferably rotated in a corresponding manner about central longitudinal housing plane 803. Hence, in the sixth embodiment of the invention, the upper and lower U-shaped armature 802 are rotated about the central longitudinal housing plane 803 in contrast to the first, second, third and fourth embodiments of the invention where the upper and lower longitudinal armature planes are oriented substantially parallel to each other and substantially parallel to the central longitudinal housing plane in question (203, 303. 403, 503).

The first rotational angle, α, is preferably set substantially equal in magnitude to the second rotational angle, β. As mentioned above, both α and β may be set to a magnitude between 2 and 15 degrees depending on the geometry of the U-shaped armatures. A first drive pin 813 is used to mechanically couple a distal or distant end portion of the deflectable leg 810 to a compliant diaphragm 814 for generation of sound pressure. A second drive pin 833 is used to mechanically couple a distal or distant end portion of the deflectable leg 830 to a second compliant diaphragm 834 for generation of a sound pressure. The first and second compliant diaphragms 814, 834 are preferably acoustically coupled to a shared front chamber situated inside the receiver housing 810 in-between the compliant diaphragms and a generated sound pressure may be conveyed to the surrounding environment through a suitable sound port acoustically coupled to the front chamber as illustrated in FIG. 7B.

Force vector $F_{1P}$ represents a force component acting on a mass centre of the deflectable leg 810 of the upper U-shaped armature 802 caused by vibratory motion of the deflectable leg in a direction perpendicular to the upper longitudinal armature plane 819. The force vector $F_{1L}$ represents a force component acting on the deflectable leg 810 in a direction parallel to the upper longitudinal armature plane 819 caused by vibratory motion of the upper curved linkage portion 808, or neck. The resulting force component caused by addition of the force components represented by force vectors $F_{1P}$ and $F_{1L}$ is represented by force vector $F_{1R}$. The force components acting on the displaceable leg 830 of the lower U-shaped armature 822 are similar as illustrated by force vectors acting on the lower deflectable leg 830 on FIG. 8A. Force vector $F_{2P}$ represents a force component acting on the deflectable leg 830 in a direction perpendicular to the lower longitudinal armature plane 839. The force vector $F_{2L}$ represents a force component acting on the deflectable leg 830 in a direction parallel to the lower longitudinal armature plane 839 caused by vibration motion of the lower curved linkage portion 828. The resulting force component caused by addition of the force vectors $F_{2P}$ and $F_{2L}$ is represented by the force vector $F_{2R}$ extending in opposite direction of the force vector $F_{1R}$ associated with the upper U-shaped armature 802 with substantially the same magnitude. Consequently, the rotated orientation of the upper and lower U-shaped armatures 802, 822, respectively, about the longitudinal housing plane 803 has caused significant suppression of the vibrational forces in direction of the longitudinal housing plane 803 and suppression of mechanical vibration in the orthogonal z-axis plane as well. Thus leading to suppression of mechanical vibration of the shared housing 801 as this is mechanically coupled to the upper and lower U-shaped armatures 802, 822, respectively, either directly or indirectly for example through respective magnet housings.

The suppression of vibration along the both x-axis plane and the z-axis plane is once again most effective if all relevant dimensions, materials and magnetic properties of the upper and lower motor assemblies, including respective U-shaped armatures 802 and 822, are substantially identical.

Figure 8B:
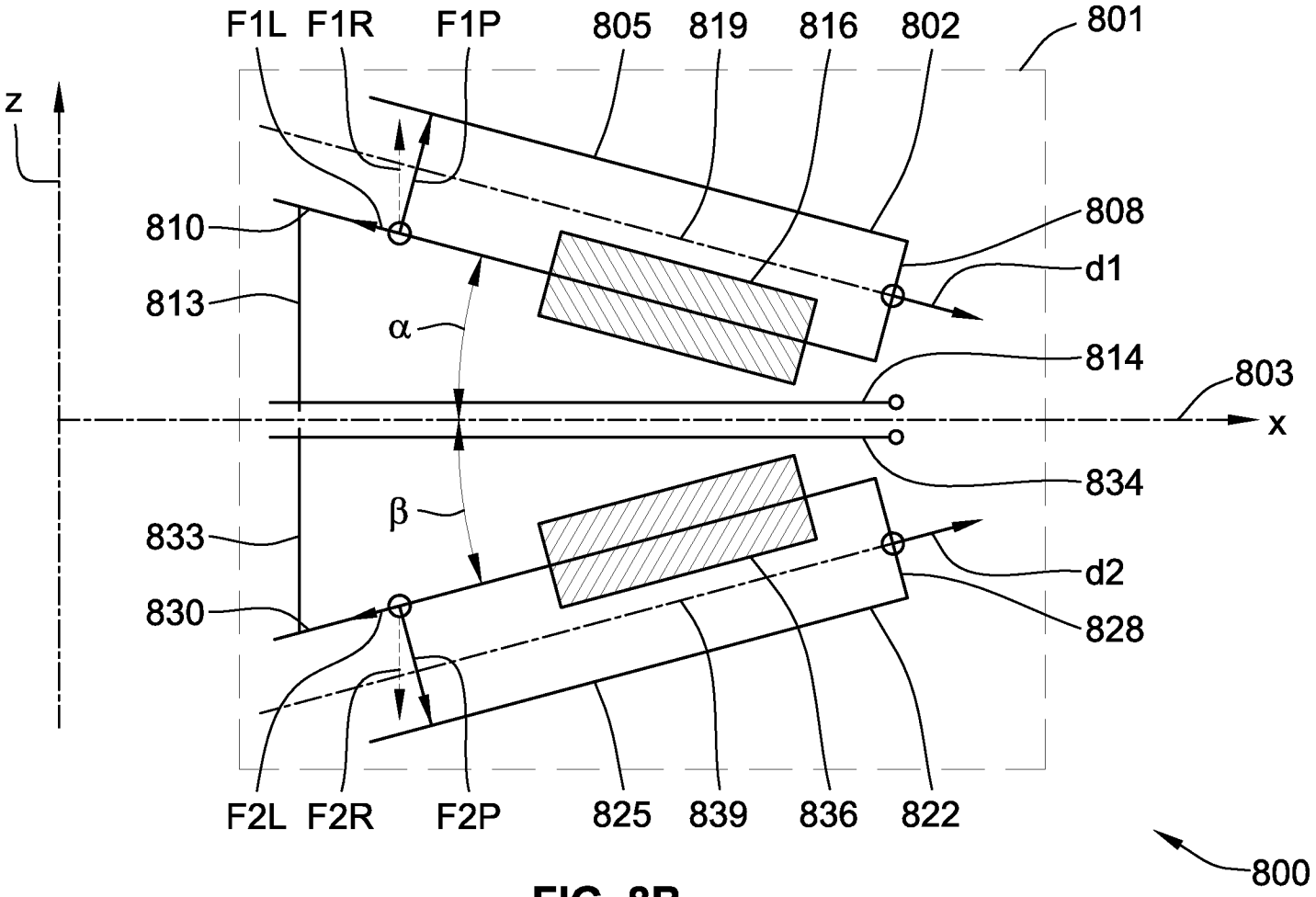
FIG. 8B is simplified schematic illustration of respective forces acting on two U-shaped armatures rotated in opposite directions about a central longitudinal housing plane according to a $6^{th}$ embodiment of the invention.

FIG. 8B is simplified schematic illustration of forces acting on a pair of U-shaped armatures 802, 822, respectively, rotated in opposite directions about a central longitudinal housing plane 803 according to a $6^{th}$ embodiment of the invention. The present embodiment is generally very similar to the above-described $5^{th}$ embodiment and the same features have been provided with the same reference numerals. As explained previously, the main difference between these embodiments is that the deflectable legs of the U-shaped armatures 802, 822, respectively, project away from the respective compliant diaphragms or speaker diaphragms 814, 834 in the present embodiment while projecting toward the respective compliant diaphragms or speaker diaphragms 814, 834 in the embodiment on FIG. 8A). Stated in another way the rotated orientations of the upper and lower U-shaped armatures have been achieved by inflicting the rotation at different ends of the U-shaped armatures either at the curved linkage portions or oppositely at the distal ends of the deflectable legs.

The invention claimed is:

1. A moving armature receiver assembly comprising, a housing structure having a longitudinal housing plane; wherein the housing structure encloses:

a first U-shaped armature comprising a fixed leg and a deflectable leg both extending parallelly to a first longitudinal armature plane and mechanically and magnetically interconnected through a first curved linkage portion, a second U-shaped armature comprising a fixed leg and a deflectable leg both extending parallelly to a second longitudinal armature plane and mechanically and magnetically interconnected through a second curved linkage portion, wherein the deflectable legs of the first and second U-shaped armatures are configured for oppositely directed displacement along an orthogonal plane extending perpendicularly to the longitudinal housing plane in response to an electrical drive signal actuating the first and second U-shaped armatures so as to suppress vibration of the housing structure in the orthogonal plane, and wherein the first and second curved linkage portions are oppositely oriented along the longitudinal housing plane and configured for oppositely directed movement along the longitudinal housing plane to suppress vibration of the housing structure in direction of the longitudinal housing plane.

2. A moving armature receiver assembly according to claim 1, wherein the housing structure encloses a shared acoustic front chamber arranged in-between a first compliant diaphragm, mechanically coupled to the deflectable leg of the first U-shaped armature via a first drive rod, and a second compliant diaphragm, mechanically coupled to the deflectable leg of the second U-shaped armature via a second drive rod.

3. A moving armature receiver assembly according to claim 2, wherein the deflectable leg of the first U-shaped armature projects through the first magnet gap such that a distal end projects out of the first magnet gap; and the deflectable leg of the second U-shaped armature projects through the second magnet gap such that a distal end projects out of the second magnet gap; and wherein the first drive rod being attached to the distal end of the deflectable leg of the first U-shaped armature and the second drive rod being attached to the distal end of the deflectable leg of the second U-shaped armature.

4. A moving armature receiver assembly according to claim 3, comprising:

a first magnet housing surrounding a first pair of facing and spaced-apart magnets forming the first magnet gap; and a second magnet housing surrounding a second pair of facing and spaced-apart magnets forming the second magnet gap.

5. A moving armature receiver assembly according to claim 4, wherein a first surface of the first magnet housing is rigidly attached to an upper inner wall of the housing structure; and a first surface of the second magnet housing is rigidly attached to a lower inner wall of the housing structure.

6. A moving armature receiver assembly according to claim 5, wherein the fixed leg of the first U-shaped armature is rigidly attached to a second surface of the first magnet housing; and the fixed leg of the second U-shaped armature is rigidly attached to a second surface of the second magnet housing.

7. A moving armature receiver assembly according to claim 2, wherein the deflectable leg of the first U-shaped armature faces away from the first diaphragm; and the deflectable leg of the second U-shaped armature faces away from the second diaphragm.

8. A moving armature receiver assembly according to claim 1, wherein the first and second U-shaped armatures are shifted away from each other along the longitudinal housing plane to render the first and second U-shaped armatures partially overlapping in the orthogonal plane with a predetermined overlap distance.

9. A moving armature receiver assembly according to claim 8, wherein the predetermined overlap distance corresponds to between 20% and 40% of a length of the first U-shaped armature.

10. A moving armature receiver assembly according to claim 9, wherein the housing structure comprises:

a first housing wall structure surrounding the first U-shaped armature and first compliant diaphragm to form a first front chamber below the first compliant diaphragm and a first back chamber above the first compliant diaphragm; and a second housing wall structure surrounding the second U-shaped armature and second compliant diaphragm to form a second front chamber above the second compliant diaphragm and a second back chamber below the second compliant diaphragm;

and wherein the first and second housing wall structures are shifted away from each other along the longitudinal housing plane with the predetermined overlap distance.

11. A moving armature receiver assembly according to claim 10, comprising an acoustic aperture extending through abutted and overlapping portions of the first and second housing wall structures to acoustically couple the first and second front chambers and thereby form the shared acoustic front chamber.

12. A moving armature receiver assembly according to claim 11, comprising a sound port coupling the shared acoustic front chamber to the external environment outside the housing structure.

13. A moving armature receiver assembly according to claim 1, wherein the first and second U-shaped armatures are aligned below each other to render the first and second U-shaped armatures completely overlapping along the orthogonal plane.

14. A moving armature receiver assembly according to claim 1, wherein the first and second longitudinal armature planes are oriented substantially parallelly to the longitudinal housing plane.

15. A moving armature receiver assembly according to claim 1, wherein at least one of materials and dimensions of the first and second U-shaped armatures are substantially identical.

16. A moving armature receiver assembly according to claim 1, further comprising:

a first drive coil forming a first coil tunnel, a second drive coil forming a second coil tunnel;

wherein the deflectable leg of the first U-shaped armature extends through the first coil tunnel and the deflectable leg of the second U-shaped armature extends through the second coil tunnel.

* * * * *